US010507685B2

(12) United States Patent
Tsukioka et al.

(10) Patent No.: US 10,507,685 B2
(45) Date of Patent: Dec. 17, 2019

(54) MECHANICAL PENCIL UNIT AND WRITING UTENSIL WITH THE MECHANICAL PENCIL UNIT

(71) Applicant: ZEBRA CO., LTD., Tokyo (JP)

(72) Inventors: Yukihiro Tsukioka, Tokyo (JP); Shigeo Abe, Tokyo (JP); Yuya Uchiyama, Tokyo (JP)

(73) Assignee: ZEBRA CO., LTD., Tokyo (JP)

( * ) Notice: Subject to any disclaimer, the term of this patent is extended or adjusted under 35 U.S.C. 154(b) by 0 days.

(21) Appl. No.: 16/069,739

(22) PCT Filed: Feb. 10, 2017

(86) PCT No.: PCT/JP2017/004859

§ 371 (c)(1),
(2) Date: Jul. 12, 2018

(87) PCT Pub. No.: WO2017/154458

PCT Pub. Date: Sep. 14, 2017

(65) Prior Publication Data

US 2019/0023058 A1 Jan. 24, 2019

(30) Foreign Application Priority Data

Mar. 10, 2016 (JP) ..... 2016-046991
Mar. 10, 2016 (JP) ..... 2016-046992
(Continued)

(51) Int. Cl.
*B43K 21/00* (2006.01)
*B43K 21/027* (2006.01)
*B43K 21/22* (2006.01)

(52) U.S. Cl.
CPC ..... *B43K 21/003* (2013.01); *B43K 21/00* (2013.01); *B43K 21/027* (2013.01); *B43K 21/22* (2013.01)

(58) Field of Classification Search
CPC .... B43K 21/00; B43K 21/027; B43K 21/003; B43K 21/22; B43K 21/006; B43K 21/02; B43K 21/033; B43K 21/06
See application file for complete search history.

(56) References Cited

U.S. PATENT DOCUMENTS 5,052,838 A * 10/1991 Tucker ..... B43K 21/22 401/65
6,547,466 B2 * 4/2003 Kageyama ..... B43K 21/22 401/67
(Continued)

FOREIGN PATENT DOCUMENTS

CN 201009560 Y 1/2008
CN 104742576 A 7/2015
(Continued)

OTHER PUBLICATIONS

Office Action issued in China Counterpart Patent Appl. No. 201780003370.2, dated Jul. 29, 2019, along with an English translation thereof.
(Continued)

*Primary Examiner* — David J Walczak
(74) *Attorney, Agent, or Firm* — Greenblum & Bernstein, P.L.C.

(57) ABSTRACT

A mechanical pencil unit is provided which includes: a holding tube; a holder which is inserted into a front side opening portion of the holding tube and which protrudes forward from a front end of the holding tube, and moreover which is supported so as to be back and forth movable relative to the holding tube; a pencil lead delivering mechanism which delivers forward a pencil lead x inserted into the holder; and a movement direction conversion mechanism which causes the holder to go forward relative to the holding tube and the pencil lead x by using a force applied in a radial direction from the pencil lead x to the holder, wherein the
(Continued)

pencil lead delivering mechanism is provided at a position further toward a rearward side than the holder and the movement direction conversion mechanism.

14 Claims, 16 Drawing Sheets

(30) Foreign Application Priority Data

Mar. 10, 2016 (JP) ..... 2016-046997
Apr. 20, 2016 (JP) ..... 2016-084223

(56) References Cited

U.S. PATENT DOCUMENTS 7,452,148 B2 * 11/2008 Fukumoto ..... B43K 21/16 401/92
8,337,107 B2 * 12/2012 Ohsawa ..... B43K 21/003 401/92
2016/0039243 A1 2/2016 Aizawa et al.

FOREIGN PATENT DOCUMENTS

JP 2013-252661 12/2013
JP 2014-198439 10/2014
JP 2015-123689 7/2015

OTHER PUBLICATIONS

Official Communication issued in International Bureau of WIPO Patent Application No. PCT/JP2017/004859, dated Apr. 25, 2017, along with an English translation thereof.

* cited by examiner

MECHANICAL PENCIL UNIT AND WRITING UTENSIL WITH THE MECHANICAL PENCIL UNIT

TECHNICAL FIELD

The present invention relates to a mechanical pencil unit that constitutes a mechanical pencil refill, a mechanical pencil, and the like and to a writing utensil with the mechanical pencil unit.

BACKGROUND ART

Conventional examples of a mechanical pencil configured to prevent a pencil lead from breaking by excessive writing pressure or the like include an invention described in PTL 1. According to the conventional invention, there are provided: a shaft tube; an approximately tubular holder which is inserted into a front side opening portion of the shaft tube and which protrudes forward from a front end of the shaft tube; and a pencil lead which is inserted into the holder and which protrudes forward, wherein movement direction converting means which causes the holder to go forward by using a force applied in a radial direction to the holder is provided between the shaft tube and the holder, and a pencil lead urge member is provided inside the shaft tube so as to urge a chuck clipping the pencil lead forward relative to the shaft tube.

According to the mechanical pencil, when a force is applied in a radial direction by writing pressure or the like to a part of the pencil lead protruding from the holder, since the holder goes forward relative to the shaft tube and the pencil lead, a front side of the pencil lead can be covered by the holder and damage to the pencil lead and the like can be prevented.

In addition, when a rearward compressing force along an axial direction is applied to the protruding pencil lead, since the chuck clipping the pencil lead moves backward against an urging force of the pencil lead urge member, damage to the pencil lead and the like can be further prevented.

CITATION LIST

Patent Literature

[PTL 1] Japanese Patent Application Laid-open No. 2015-123689

[PTL 2] Japanese Patent Application Laid-open No. 2014-198439

SUMMARY OF INVENTION

Technical Problem

However, according to the prior art described above, since the chuck clipping the pencil lead, a tubular member housing the chuck, and the like are provided so as to overlap with each other in the radial direction inside the holder, an outer diameter is likely to increase and an application as a mechanical pencil refill to a retractable writing utensil (for example, refer to PTL 2) and the like in which each refill is relatively slim is difficult.

Solution to Problem

In consideration of the problem described above, the present invention provides the following configuration.

A mechanical pencil unit, including: a holding tube; a holder which is inserted into a front side opening portion of the holding tube and which protrudes forward from a front end of the holding tube, and moreover which is supported so as to be back and forth movable relative to the holding tube; a pencil lead delivering mechanism which delivers forward a pencil lead inserted into the holder; and a movement direction conversion mechanism which causes the holder to go forward relative to the holding tube and the pencil lead using a force in a radial direction being applied from the pencil lead to the holder, wherein the pencil lead delivering mechanism is provided at position toward a rearward side than the holder and the movement direction conversion mechanism.

BRIEF DESCRIPTION OF DRAWINGS

FIG. 2A shows an example of a third tube portion, in which FIG. 2A is a full sectional view.

FIG. 2B shows an example of a third tube portion, in which FIG. 2B is a rear end face view.

FIG. 3A shows an example of a connector, in which FIG. 3A is a half sectional view.

FIG. 3B shows an example of a connector, in which FIG. 3B is a rear end face view.

DESCRIPTION OF EMBODIMENTS

Figure 1:
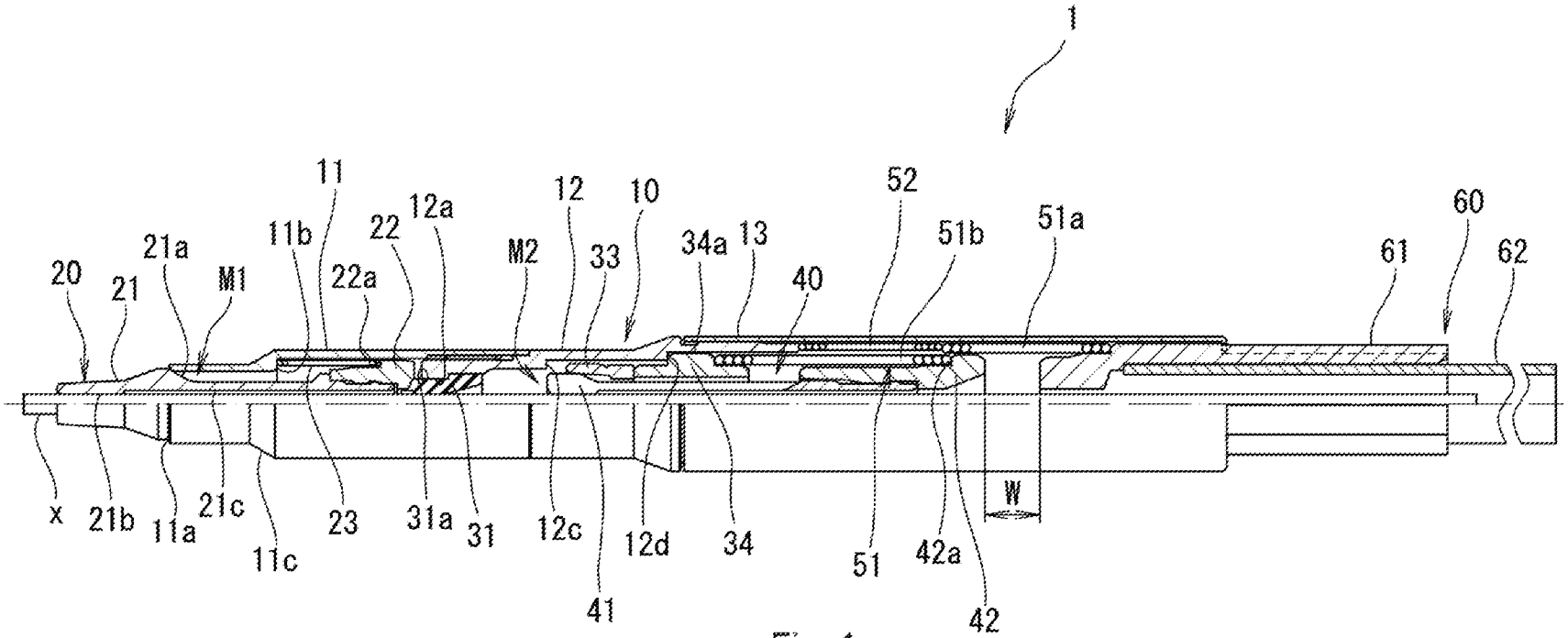
FIG. 1 is a half sectional view showing a first embodiment of a mechanical pencil unit according to the present invention.

A present embodiment discloses the following features.

A first feature includes: a holding tube; a holder which is inserted into a front side opening portion of the holding tube and which protrudes forward from a front end of the holding tube, and moreover which is supported so as to be back and forth movable with relative to the holding tube; a pencil lead delivering mechanism which delivers forward a pencil lead inserted into the holder; and a movement direction conversion mechanism which causes the holder to go forward relative to the holding tube and the pencil lead by using a force applied in a radial direction from the pencil lead to the holder, wherein the pencil lead delivering mechanism is provided at a position further toward a rearward side than the holder and the movement direction conversion mechanism (refer to FIGS. 1 to 16).

According to this configuration, an outer diameter can be reduced as compared to prior part and, for example, an application as a detachable mechanical pencil refill of a retractable writing utensil or the like can be facilitated.

In a second feature, in order to effectively transmit a force in a radial direction from a pencil lead to a holder, in addition to the first feature described above, on an inner circumference face of the holder, a pencil lead sliding contact surface which slidingly contacts an outer circumference face of the pencil lead on a front end side of the inner circumference face and a pencil lead guide surface which is adjacent to the outer circumference face of the pencil lead at a position further toward a rear side than the pencil lead sliding contact surface are formed.

In a third feature, in order to improve productivity, in addition to the first or second feature described above, the holding tube includes a first tube portion immanent so as to cause the holder to protrude forward and a second tube portion connected to a rearward side of the first tube portion, wherein the holder and the movement direction conversion mechanism are provided inside the first tube portion and the pencil lead delivering mechanism is provided inside the second tube portion.

In a fourth feature, in addition to any of the first to third features described above, the pencil lead delivering mechanism includes a pencil lead breaker which is loosely pressure contacted by the outer circumference face of the pencil lead being delivered forward.

In a fifth feature, in order to mitigate impact when a holder moves backward, in addition to the fourth feature described above, the pencil lead breaker receives from a rearward side thereof the holder by a front end side part made of an elastic material and the pencil lead breaker is supported inside the holding tube.

In a sixth feature, in order to prevent slippage of a pencil lead breaker or the like, in addition to the fifth feature described above, an annular projected portion which protrudes in a radially inner direction is provided inside the holding tube, and the pencil lead breaker is formed in an approximately tubular shape having an annular recessed portion in an outer circumference portion thereof and causes the annular recessed portion to fit with the annular projected portion (refer to FIGS. 11A to 14B).

In a seventh feature, in order to absorb excessive writing pressure in an axial direction, in addition to the fourth to sixth features described above, the pencil lead delivering mechanism includes a chuck portion which delivers forward a clipped pencil lead by a prescribed operation, the pencil lead delivering mechanism is immanent in the holding tube and the holding tube holds the chuck portion so as to be back and forth movable, the seventh feature further including: a pencil lead tank portion which is connected to the holding tube so as to supply a pencil lead to the pencil lead delivering mechanism from a rearward side; and a first urge member which urges the chuck portion forward relative to the pencil lead tank portion with an urging force set in advance which is stronger than writing pressure.

In an eighth feature, in order to improve performance when absorbing excessive writing pressure in an axial direction, in addition to the seventh feature described above, the holding tube is connected to the pencil lead tank portion so as to go back and forth by a prescribed amount, and a second urge member which urges the holding tube forward relative to a front end portion of the first urge member and the urging force of which is smaller than that of the first urge member is provided.

In a ninth feature, in order to improve both performance when absorbing excessive writing pressure in an axial direction and performance during pencil lead deliver, in addition to the eighth feature described above, the pencil lead delivering mechanism includes: the chuck portion which elastically deflects in a radially inner direction and which clips a pencil lead; a clutch ring which fits with the chuck portion in a clipping state and, when going forward together with the chuck portion, touches a touched portion of an inner face of the holding tube and disengages from the chuck portion; a clutch receiver which is provided so as to go back and forth by a prescribed amount inside the holding tube and which receives the clutch ring from a rearward side; the pencil lead breaker which is positioned on a further forward side than the clutch ring; and a third urge member which urges the chuck portion rearward relative to the clutch receiver, wherein an urging force of the third urge member is set larger than an urging force of the first urge member, and the pencil lead tank portion and the chuck portion are provided so as to have a space in a back and forth direction and are provided so that one of the pencil lead tank portion and the chuck portion touches the other of the pencil lead tank portion and the chuck portion by narrowing the space.

In a tenth feature, in order to prevent clogging of a pencil lead or the like, in addition to the ninth feature described above, a rear end side of the chuck portion is provided with a touching portion which touches a front end portion of the pencil lead tank portion when the space is narrowed and a pencil lead introducing portion which is provided so as to extend rearward from the touching portion and which is inserted into the pencil lead tank portion on a rear side of the space (refer to FIGS. 12A to 14B).

In an eleventh feature, in order to prevent urge members from interfering with each other, in addition to the ninth or tenth feature described above, the clutch receiver is formed in a tubular shape, and the second urge member and the third urge member are respectively provided on an outer side and an inner side of a side wall of the clutch receiver in a radial direction thereof (refer to FIGS. 12A to 14B).

In a twelfth feature, in order to further improve performance when absorbing excessive writing pressure in an axial direction, in addition to any of the ninth to eleventh features described above, an urging force of the second urge member is set larger than a resistance force in a back and forth direction between the pencil lead breaker and a pencil lead.

Figure 15:
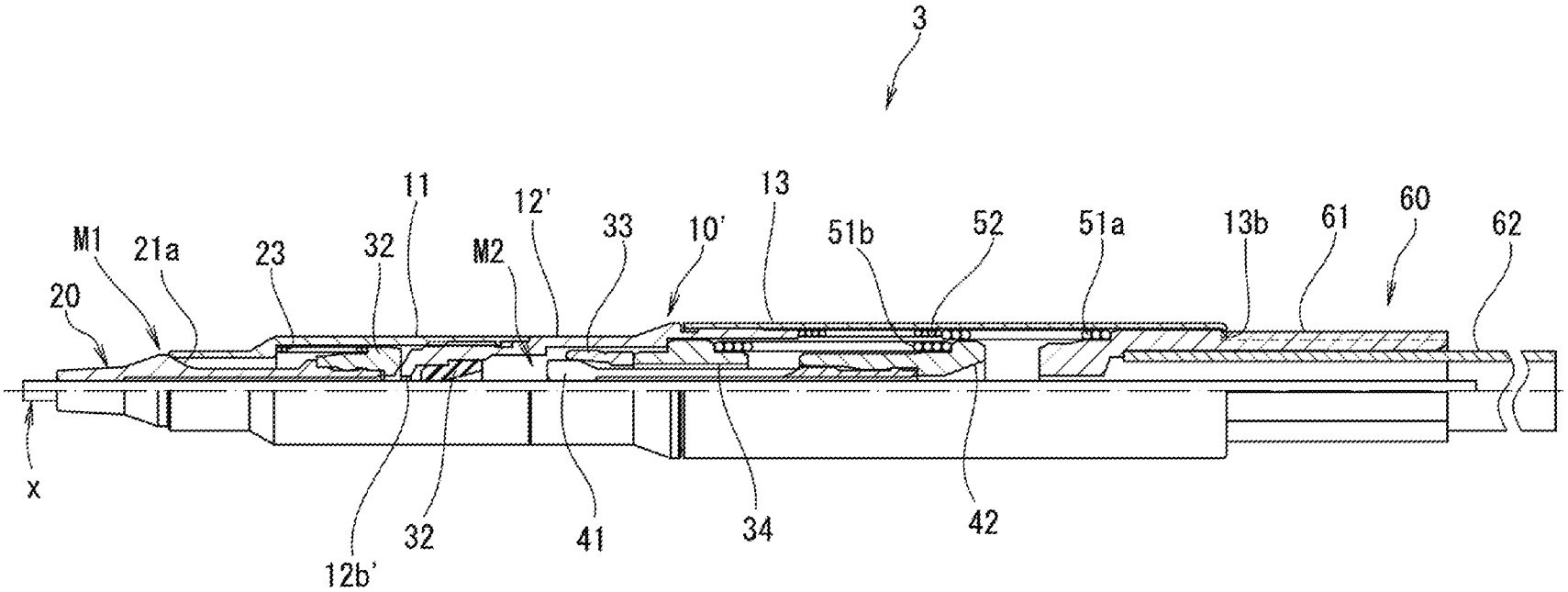
FIG. 15 is a half sectional view showing a third embodiment of a mechanical pencil unit according to the present invention.
Figure 16:
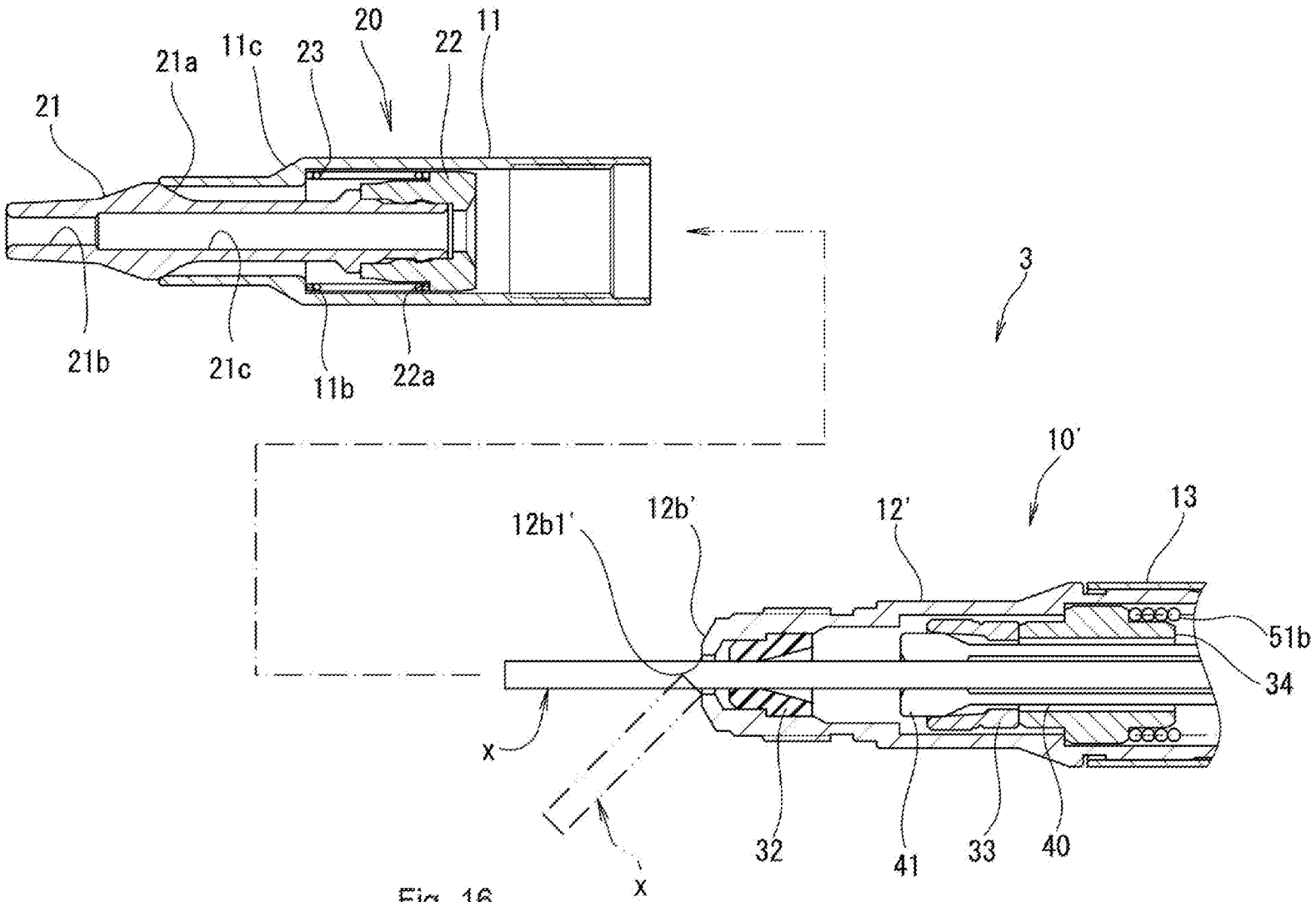
FIG. 16 is a full sectional view of features showing a state where a first tube portion has been removed according to the third embodiment.

In a thirteenth feature, in order to prevent clogging of a broken pencil lead or the like, in addition to any of the first to twelfth features described above, the holding tube is provided with a hard annular protrusion which is adjacent to or which contacts an outer circumference face of a pencil lead delivered by the pencil lead delivering mechanism (refer to FIGS. 15 and 16).

In a fourteenth feature, a writing utensil is configured so as to include the mechanical pencil unit with any of the first to thirteenth features described above (refer to FIG. 4).

First Embodiment

Next, specific embodiments having the features described above will be described in detail based on the drawings. Moreover, in the present specification, an axial direction refers to a direction in which a central line of a holding tube or a shaft tube extends. In addition, "front" refers to one side of the axial direction which is a direction in which a pencil lead is delivered. Furthermore, "rear" refers to a side of an opposite direction to the one side of the axial direction. In addition, a "radial direction" refers to a direction perpendicular to the axial direction. Furthermore, a "radially outer direction" refers to a direction separating from an axial center along the radial direction. A "radially inner direction" refers to a direction approaching the axial center along the radial direction.

A mechanical pencil unit 1 shown in FIG. 1 includes: a holding tube 10; a holder 20 which is inserted into the holding tube 10 and protrudes forward from a front end of the holding tube 10 and which is supported so as to be back and forth movable relative to the holding tube 10; a pencil lead delivering mechanism M2 which delivers a pencil lead x clipped by a chuck portion 40 with a back and forth movement; a movement direction conversion mechanism M1 which causes the holder 20 to go forward relative to the holding tube 10 and the pencil lead x using a force in a radial direction being applied to the holder 20 between the holding tube 10 and the holder 20; a pencil lead tank portion 60 which supplies the pencil lead x from a rearward side to the pencil lead delivering mechanism M2; and the like.

The holding tube 10 is constituted in an integral tubular shape by a first tube portion 11 being immanent so as to cause the holder 20 to protrude forward, a second tube portion 12 coaxially connected to a rear end side of the first tube portion 11, and a third tube portion 13 coaxially connected to a rear end side of the second tube portion 12.

The first tube portion 11 is a cylindrical member having front and rear end portions opened, and the movement direction conversion mechanism M1, a holder urge member 23, and the like are immanent therein.

A stepped locking portion 11*b* for locking a front end portion of the holder urge member 23 is provided on an inner circumference face of the first tube portion 11.

A locking stepped portion 11*c* for locking the first tube portion 11 to a front end opening edge of a shaft tube a1 (refer to FIG. 4) of the retractable writing utensil is formed on a front end side of an outer circumference face of the first tube portion 11.

The holder urge member 23 is a compression coil spring according to the illustrated example, and urges the holder 20 rearward by touching the locking portion 11*b* with a front end portion thereof and touching a receiver 22 with a rear end portion thereof.

The holder 20 is integrally constituted by a holder main body portion 21 and the receiver 22 connected to a rear side of the holder main body portion 21, and is supported so as to be back and forth movable relative to the holding tube 10.

The holder main body portion 21 is an approximately cylindrical member which is inserted into the holding tube 10 and which protrudes forward from a front side opening portion 11*a* of the holding tube 10. An annular cam slope 21*a* which slidingly contacts a front end opening edge of the first tube portion 11 is provided in an outer circumference portion of the holder main body portion 21.

According to the illustrated example, the cam slope 21*a* is formed in a conical face shape of which a diameter increases forward, and constitutes the movement direction conversion mechanism M1 which moves the holder 20 forward relative to the holding tube 10 and the pencil lead x using a force in a radial direction being applied to the holder 20.

In addition, a pencil lead sliding contact surface 21*b* which slidingly contacts an outer circumference face of the pencil lead x on a front side of the cam slope 21*a* and a pencil lead guide surface 21*c* which is adjacent across a small space to the outer circumference face of the pencil lead x on a rear side of the pencil lead sliding contact surface 21*b* are formed on an inner circumference face of the holder main body portion 21.

Furthermore, the receiver 22 which receives a rear end of the holder urge member 23 is integrally connected to a rear end side of the holder main body portion 21.

The receiver 22 is formed in an approximately cylindrical shape having a stepped portion 22*a* which receives the holder urge member 23 on an outer circumference face thereof. An annular inclined face 22*b* (refer to FIG. 10A) of which a diameter gradually decreases forward is formed on a center side of a rear end face of the receiver 22. The annular inclined face 22*b* guides the front end portion of the pencil lead to a central portion of the receiver 22 when the pencil lead x is inserted from the rearward side, and when the receiver 22 moves backward, the annular inclined face 22*b* touches a front end portion of a pencil lead breaker 31 to be described later.

Moreover, while the receiver 22 is a separate member from the holder main body portion 21 according to the illustrated example, as another example, the receiver 22 may be configured as a portion integrally formed on a rear end side of the holder main body portion 21.

In addition, the second tube portion 12 is a cylindrical member connected to a rear end side of the first tube portion 11 by connecting means such as screwing, fitting, and the like. An annular projected portion 12*a* which protrudes in a radially inner direction is formed near a front end on an inner circumference face of the second tube portion 12.

The pencil lead breaker 31 is formed in an approximately cylindrical shape of an elastic material, loosely pressure contacts the outer circumference face of the inserted pencil lead x with an inner circumference face thereof, and receives the holder 20 having moved backward with a front end face thereof.

A reduced diameter portion 31*a* of which a diameter is reduced stepwise is formed on a front half portion side on an outer circumference face of the pencil lead breaker 31. The reduced diameter portion 31*a* is fitted to and inserted into an inner circumference face of the annular projected portion 12*a* on a front end side of the second tube portion 12. In addition, a front end side of the reduced diameter portion 31*a* protrudes more forward than the front end of the second tube portion 12.

Furthermore, a large diameter part on a rear side of the reduced diameter portion 31*a* on the outer circumference face of the pencil lead breaker 31 elastically fits with the second tube portion 12 to prevent the pencil lead breaker 31 from moving backward relative to the second tube portion 12.

In addition, in the second tube portion 12, a chuck portion 40 supported so as to be back and forth movable and a clutch ring 33 annularly fitted with the chuck portion 40 are provided on a rear side of the pencil lead breaker 31.

The chuck portion 40 is integrally constituted by a chuck main body 41 and a receiver 42 connected to a rear end side of the chuck main body 41.

The chuck main body 41 is constructed by integrally coupling a plurality of (for example, about two to four) elongated pieces arranged annularly at intervals in a circumferential direction on rear end sides of the elongated pieces. In addition, the chuck main body 41 causes the plurality of elongated pieces to elastically deform in a radially inner direction and clips the pencil lead x with claw portions on a front end side of the elongated pieces.

The clutch ring 33 fits with the chuck main body 41 in a clipping state and, when having gone forward together with the chuck main body 41, touches a stepped locking portion 12*c* on an inner face of the holding tube 10 and disengages from the plurality of claw portions and releases a front end side of the chuck main body 41. Structures of the chuck main body 41 and the clutch ring 33 are approximately similar to known structures.

The chuck portion 40, the clutch ring 33, the locking portion 12*c*, the pencil lead breaker 31, and the like described above constitute the pencil lead delivering mechanism M2.

The pencil lead delivering mechanism M2 is provided in the second tube portion 12 at a position further toward a rearward side than the holder 20 and the movement direction conversion mechanism M1.

In addition, in the second tube portion 12, an approximately cylindrical clutch receiver 34 is provided on a rear side of the clutch ring 33 so as to go back and forth by a prescribed amount in the second tube portion 12.

The clutch receiver 34 has the chuck main body 41 loosely inserted on a center side thereof.

An annular protruding portion 34*a* is provided on an outer circumference portion of the clutch receiver 34 so as to protrude in a radially outer direction from near center in a front and rear direction. The annular protruding portion 34*a* touches, from the rearward side, a stepped touched portion 12*d* on an inner circumference face of the second tube portion 12. By being touched, the touched portion 12*d* restricts forward movement of the entire clutch receiver 34.

A rear end portion of the annular protruding portion 34*a* receives a front end portion of a third urge member 51*b* to be described later.

In addition, a frontmost end portion of the clutch receiver 34 receives a rear end portion of the clutch ring 33.

Moreover, the clutch receiver 34 need only be provided so as to go back and forth by a prescribed amount in the holding tube 10, be configured to receive the clutch ring 33 from a rearward side, and be urged forward by the third urge member 51*b*, and a shape other than that of the illustrated example can be adopted.

In addition, the receiver 42 is an approximately cylindrical member and has a stepped portion 42*a* which receives the third urge member 51*b* on a rear end side of an outer circumference face of the receiver 42. The receiver 42 integrally goes back and forth together with the chuck main body 41 in the holding tube 10.

Moreover, while the receiver 42 is configured as a separate member from the chuck main body 41 according to the illustrated example, the receiver 42 may also be configured as a portion integrally formed on a rear end side of the chuck main body 41.

Figure 2B:
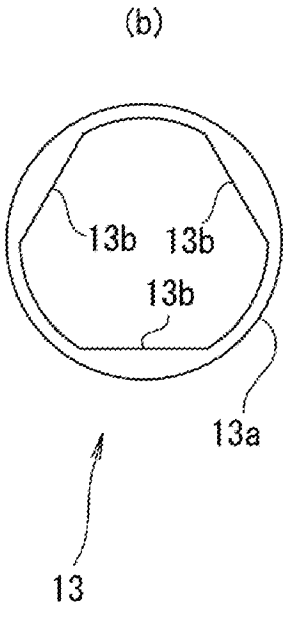
Figure 2A:
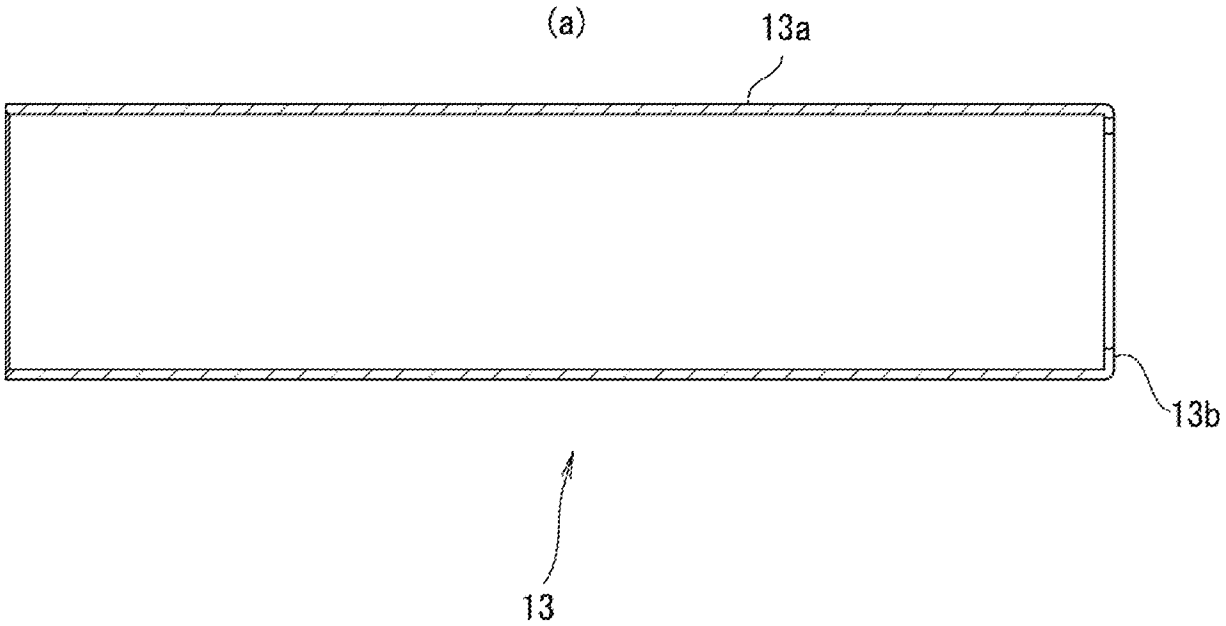

Furthermore, as exemplified in FIGS. 2A and 2B, the third tube portion 13 is an approximately elongated cylindrical member having front and rear end portions opened. More specifically, the third tube portion 13 is constituted by a cylindrical tube portion main body 13*a* and an engaging portion 13*b* which protrudes in a radially inner direction from a rear end edge of the tube portion main body 13*a*.

The engaging portion 13*b* is provided in plurality at intervals in a circumferential direction. According to the example shown in FIGS. 2A and 2B, each engaging portion 13*b* is formed in a linear protruding piece-shape which is approximately parallel to a tangent of a circumferential circle of the tube portion main body 13*a*. The engaging portion 13*b* engages with a connector 61 of the pencil lead tank portion 60 to be described later so as to go back and forth.

A plurality of urge members provided in the second tube portion 12 and the third tube portion 13 will now be described in detail.

A chuck portion urge member 51 which urges the chuck portion 40 forward and rearward with different urging forces and a second urge member 52 are provided in the second tube portion 12 and the third tube portion 13.

The chuck portion urge member 51 in the illustrated example is a two-stage spring integrally constituted by a first urge member 51*a* and the third urge member 51*b* which continues to a front side of the first urge member 51*a*.

Alternatively, as will be described later as another example, the first urge member 51*a* and the third urge member 51*b* can also be respectively configured as independent springs.

An urging force of the first urge member 51*a* is set so as to urge, relative to the pencil lead tank portion 60, the chuck portion 40 forward with an urging force set in advance which is stronger than writing pressure. The writing pressure is a rearward force applied to the pencil lead x in an ordinary writing posture and is obtained in advance by an experiment, a calculation, or the like.

An outer diameter of a coil spring that constitutes the first urge member 51*a* is set larger than an outer diameter of a coil spring that constitutes the third urge member 51*b*, and an urging force of the third urge member 51*b* is set larger than an urging force of the first urge member 51*a*.

A rear end portion of the first urge member 51*a* touches the pencil lead tank portion 60 to be described later. In addition, the first urge member 51*a* engages a front end side part thereof with the receiver 42 and urges the receiver 42 forward.

A rear end portion of the third urge member 51*b* is received by the stepped portion 42*a* of the receiver 42, a front end portion of the third urge member 51*b* touches the annular protruding portion 34*a* of the clutch receiver 34, and the third urge member 51*b* urges the chuck portion 40 rearward relative to the clutch receiver 34.

In addition, the second urge member 52 is a coil spring with a smaller urging force than the first urge member 51*a*. The urging force of the second urge member 52 is set larger than a resistance force in a back and forth direction by friction and the like between the pencil lead breaker 31 and the pencil lead x.

By touching a stepped portion (specifically, the rear end portion of the second tube portion 12) on an inner face of the holding tube 10 with a front end portion and touching a front end portion of the first urge member 51*a* with a rear end portion, the second urge member 52 urges the entire holding tube 10 forward relative to the front end portion of the first urge member 51*a*.

Furthermore, the pencil lead tank portion 60 is configured in an approximately tubular shape having a front end portion opened and is connected so as to be back and forth movable to a rear end side of the holding tube 10 so as to supply the pencil lead x from a rearward side to the pencil lead delivering mechanism M2.

The pencil lead tank portion 60 is integrally constituted by the connector 61 and a tank main body 62 connected to a rear end side of the connector 61.

Figure 3B:
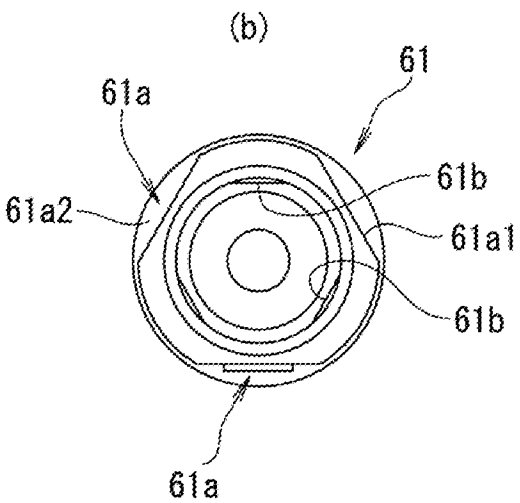
Figure 3A:
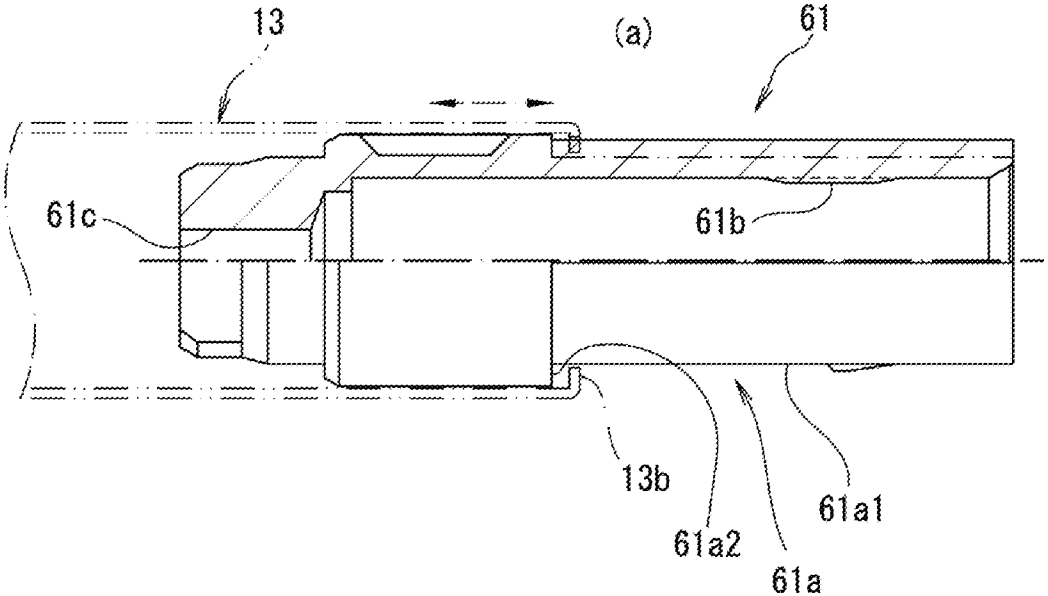

As exemplified in FIGS. 3A and 3B, the connector 61 is an approximately cylindrical member and has, on a rear portion side of an outer circumference face thereof, an engaged portion 61*a* which engages with the engaging portion 13*b* (refer to FIGS. 2A and 2B) of the third tube portion 13 so as to be back and forth movable.

The engaged portion 61*a* includes a flat face-shaped guide surface 61*a*1 provided so as to extend back and forth and a front side restricting portion 61*a*2 which protrudes in a radially outer direction from a front end of the guide surface 61*a*1 and which restricts forward movement of the engaging portion 13*b*.

In addition, an inner circumference face of a rear portion side of the connector 61 is formed in a cylindrical shape which fits with an outer circumference face of a front end side of the tank main body 62. In FIGS. 3A and 3B, a reference sign 61*b* denotes a protruding portion 61*b* which is touched with pressure by an outer circumference face of the tank main body 62, and a reference sign 61*c* denotes a guide hole which guides the pencil lead x forward one by one.

According to the connector 61 with the shape described above, since a plurality of the guide surfaces 61*a*1 are formed in a polygonal shape (a triangular shape according to the example shown in FIG. 3B), compared to a hypothetical case in which the guide surface 61*a*1 is formed in a cylindrical face shape, an area where the engaging portion 13*b* is hooked can be increased, and thin-wall parts can be reduced to realize a structure with high strength.

Alternatively, as another example, the engaging portion 13*b* can be configured as a partial protrusion which protrudes in a radially inner direction and the engaged portion 61*a* can be configured as a groove which fits with the protrusion and which guides the protrusion in a front and rear direction.

The tank main body 62 is an elongated cylindrical member having front and rear end portions opened, and a front end side of the tank main body 62 is inserted to the connector 61 to be fitted with and fixed by the connector 61.

Moreover, while the connector 61 and the tank main body 62 are constituted by separate members in the illustrated example, as another example, the connector 61 and the tank main body 62 can also be constituted by an integrated member.

Figure 4:
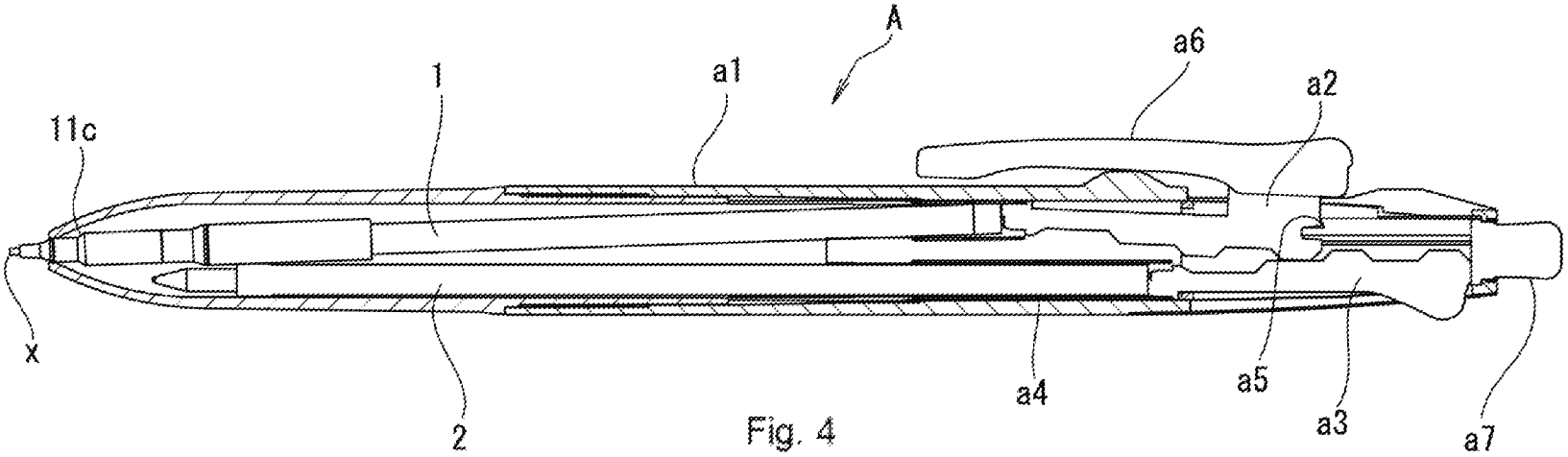
FIG. 4 is an internal structural diagram showing an example of a retractable writing utensil including the mechanical pencil unit, in which only a shaft tube is shown in a full section.

In addition, the mechanical pencil unit 1 configured as described above can be mounted to, for example, a multi-function retractable writing utensil A shown in FIG. 4.

By an operation for selectively causing a plurality of pieces a2 and a3 which are to be exposed to the outside on a rear end side of the shaft tube a1 to go forward, the multi-function retractable writing utensil A causes a front end writing portion of a refill connected to the piece a2 (or a3) having gone forward to protrude forward from a front end of the shaft tube a1. According to the illustrated example, the refill is the mechanical pencil unit 1 or a ballpoint pen refill 2.

For example, as shown in FIG. 4, when the piece a2 having a clip a6 with an opening and closing function is operated so as to go forward against an urging force of a coil spring a4 and the front end writing portion of the mechanical pencil unit 1 (a refill) connected to the piece a2 protrudes forward from a front end opening portion of the shaft tube a1, the piece a2 is locked by a locking portion a5 on a circumferential wall of the shaft tube a1 and this protruding state is maintained.

In this protruding state, by performing a prescribed operation (specifically, an operation causing the clip a6 to go forward or an operation causing a tail plug a7 to go forward), the pencil lead x is delivered from a front end of the mechanical pencil unit 1.

Moreover, a basic structure of the multi-function retractable writing utensil A is approximately similar to that described in PTL 2.

Next, characteristic operational effects of the mechanical pencil unit 1 and the multi-function retractable writing utensil A will be described.

First, an operation when delivering the pencil lead x will be described in detail based on FIGS. 5A, 5B, 6C, and 6D.

Figure 5A:
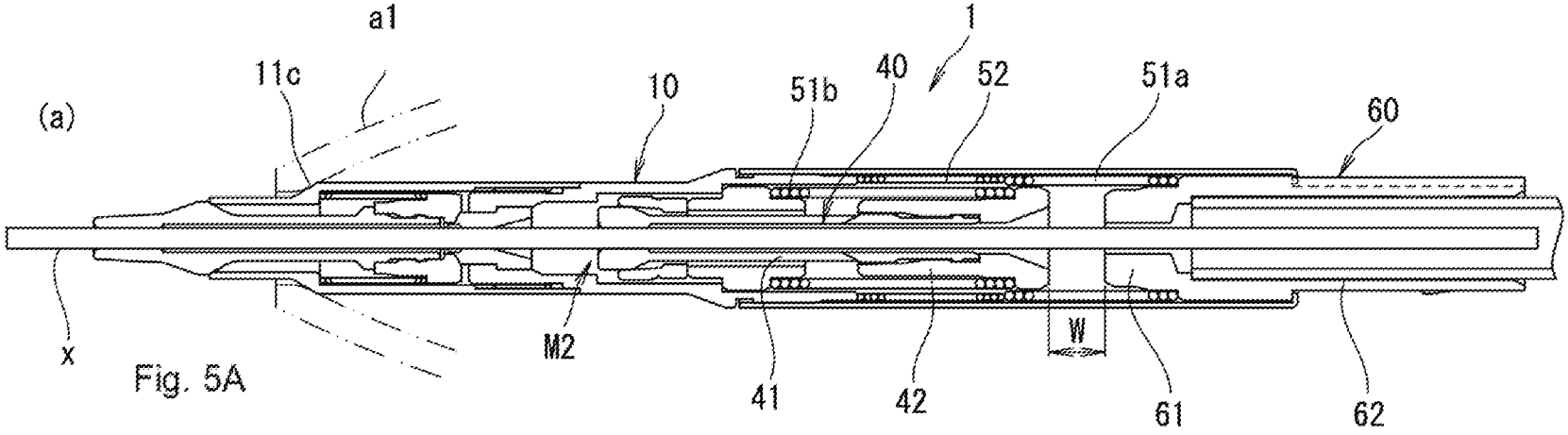
FIG. 5A is a full sectional view sequentially showing an operation for delivering a pencil lead according to the first embodiment.

When the piece a2 is caused to go forward in a protruding state of a writing portion shown in FIG. 4, as shown in FIG. 5A, the locking stepped portion 11*c* on the front end side of the holding tube 10 is locked by the front end opening edge of the shaft tube a1 and forward movement of the holding tube 10 is restricted.

Figure 5B:
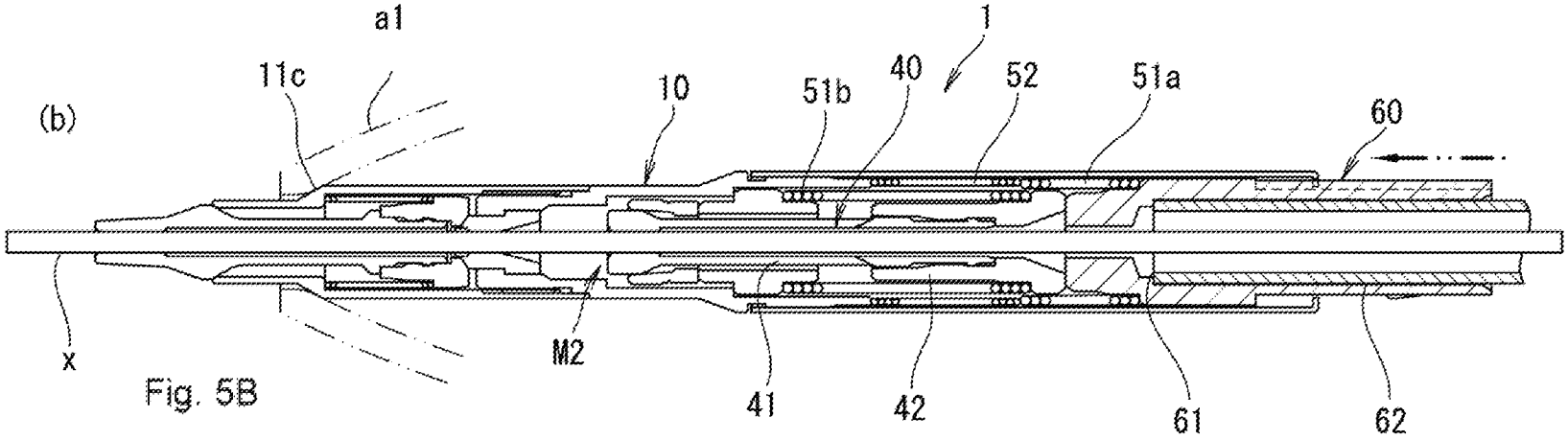
FIG. 5B is a full sectional view sequentially showing an operation for delivering a pencil lead according to the first embodiment in continuation from FIG. 5A, in which only a part having moved from a previous state is indicated by hatching.

When the piece a2 is caused to go further forward in this restricted state, as shown in FIG. 5B, the pencil lead tank portion 60 (a hatched part) integrally goes forward with the piece a2. During going forward, a position of the chuck portion 40 is held by a rearward urging force of the third urge member 51*b* and only the first urge member 51*a* with a smaller urging force than the third urge member 51*b* contracts.

Therefore, a space W between the chuck portion 40 and the pencil lead tank portion 60 decreases and a front end of the pencil lead tank portion 60 touches a rear end of the chuck portion 40.

Figure 6C:
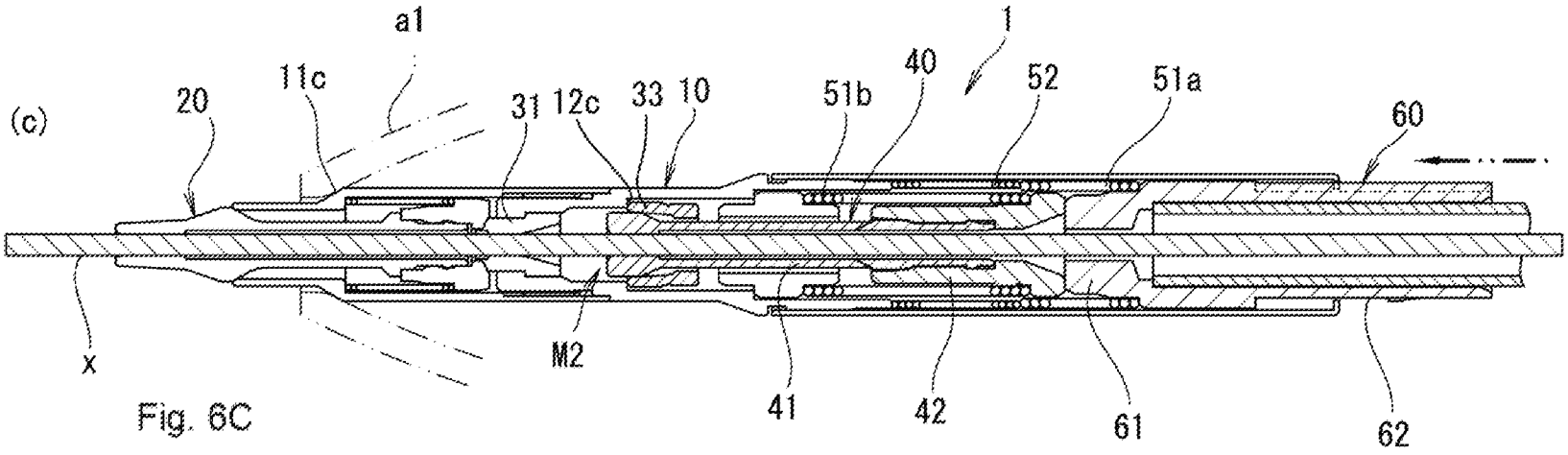
FIG. 6C is a full sectional view sequentially showing an operation for delivering a pencil lead in continuation from FIG. 5B, in which only a part having moved from a previous state is indicated by hatching.

Next, when the pencil lead tank portion 60 goes further forward by an operation performed on the piece a2, as shown in FIG. 6C, the chuck portion 40 clipping the pencil lead x is compressed by the pencil lead tank portion 60 and goes forward and the clutch ring 33 touches the locking portion 12*c*.

Figure 6D:
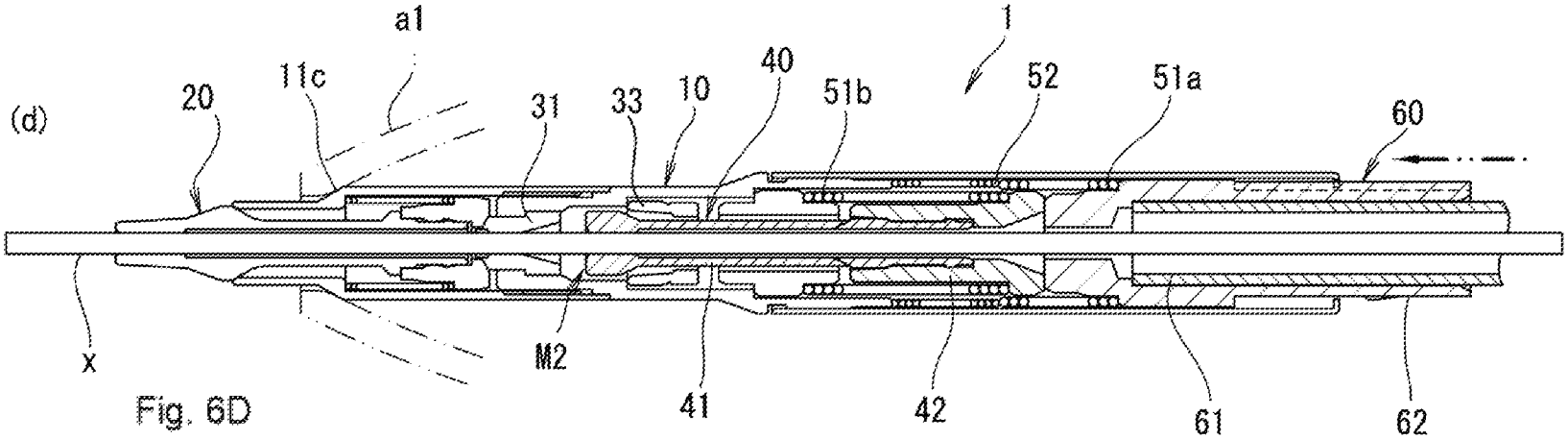
FIG. 6D is a full sectional view sequentially showing an operation for delivering a pencil lead in continuation from FIG. 6C, in which only a part having moved from a previous state is indicated by hatching.

Subsequently, when the chuck portion 40 goes further forward, as shown in FIG. 6D, the clutch ring 33 touching the locking portion 12*c* disengages from the claw portions on the front end side of the chuck portion 40 and the chuck portion 40 elastically opens to release the pencil lead x. Since the released pencil lead x is loosely pressure contacted by the pencil lead breaker 31, the pencil lead x is held without moving back and forth.

Next, when a compressing force on the pencil lead tank portion 60 is removed, the chuck portion 40 moves backward, fits with the clutch ring 33, and clips the pencil lead x to restore the state shown in FIG. 5A.

Accordingly, the pencil lead can be delivered by a back and forth movement of the pencil lead tank portion 60.

Next, an operation when an excessive rearward compressing force is applied to the pencil lead x will be described in detail based on FIGS. 7A and 7B.

Figure 7A:
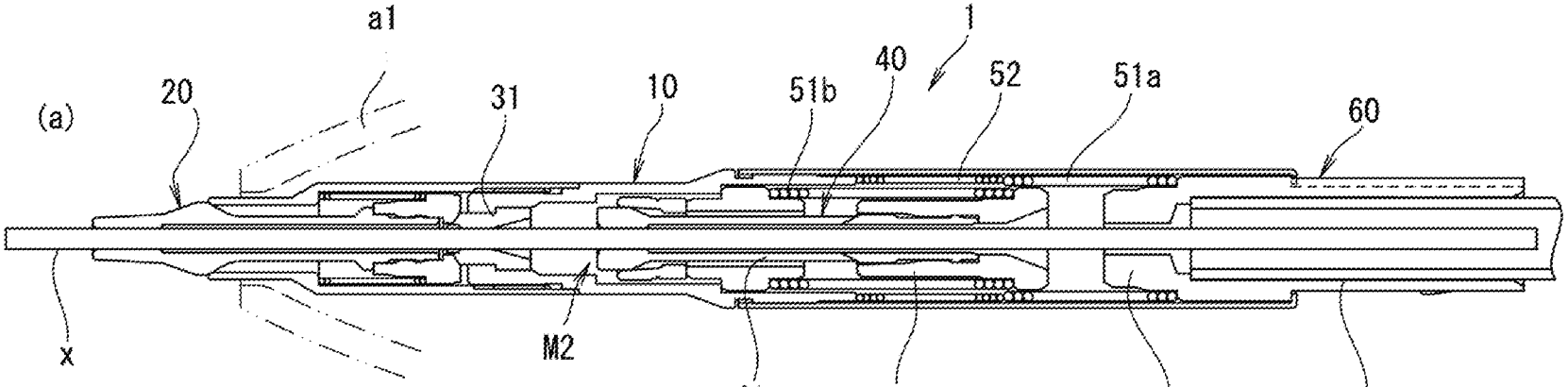
FIG. 7A is a full sectional view sequentially showing a situation where a pencil lead moves backward by a rearward compressing force according to the first embodiment.

FIG. 7A shows a state (refer to FIG. 4) where the mechanical pencil unit 1 is locked while protruding from the shaft tube a1. In this protruding state, the pencil lead tank portion 60 is held by the piece a2 of the multi-function retractable writing utensil A so as to be incapable of moving backward.

Figure 7B:
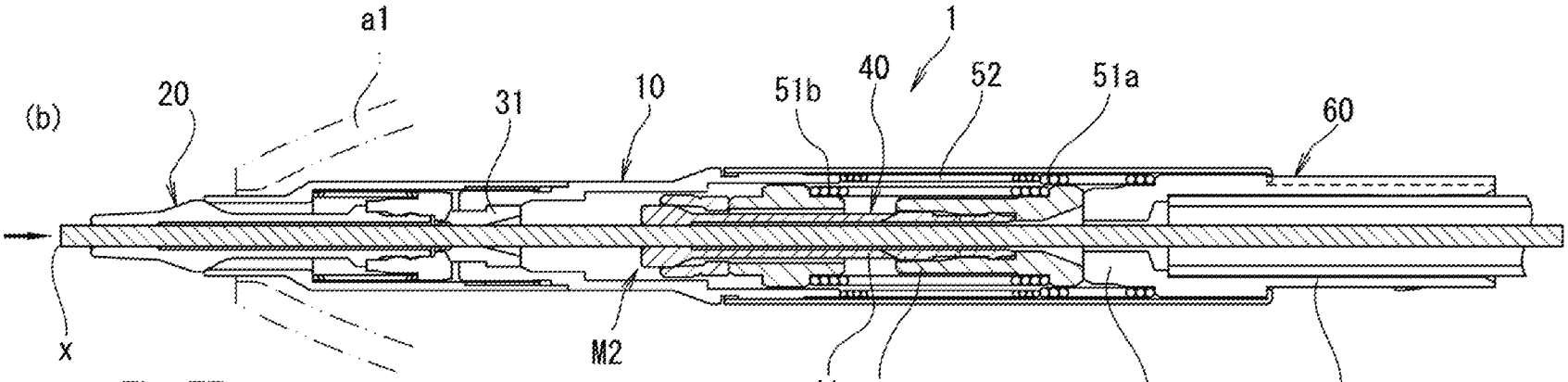
FIG. 7B is a full sectional view sequentially showing a situation where a pencil lead moves backward by a rearward compressing force according to the first embodiment in continuation from FIG. 7A, in which only a part having moved from a previous state is indicated by hatching.

When an excessive rearward force along an axial direction is applied to the pencil lead x by writing or the like in this protruding state, as shown in FIG. 7B, the pencil lead x and the chuck portion 40 clipping the pencil lead x cause the first urge member 51*a* to contract and, at the same time, cause the second urge member 52 to extend by elastic restoration and then move backward. Therefore, breakage and damage of the pencil lead x can be prevented.

Moreover, in a favorable example of the present embodiment, since the holding tube 10 is urged forward relative to the chuck portion 40 by the second urge member 52 having an urging force smaller than that of the first urge member 51*a*, the holding tube 10 is prevented from moving backward in association with the backward movement of the chuck portion 40 and the pencil lead x having moved backward can be reliably housed inside the holder 20 and the holding tube 10.

In addition, an amount of backward movement of the chuck portion 40 is to be restricted as the receiver 42 of the chuck portion 40 touches the connector 61 of the pencil lead tank portion 60.

Next, an operation when an excessive compressing force in a radial direction is applied to the pencil lead x will be described in detail based on FIGS. 8A and 8B.

Figure 8A:
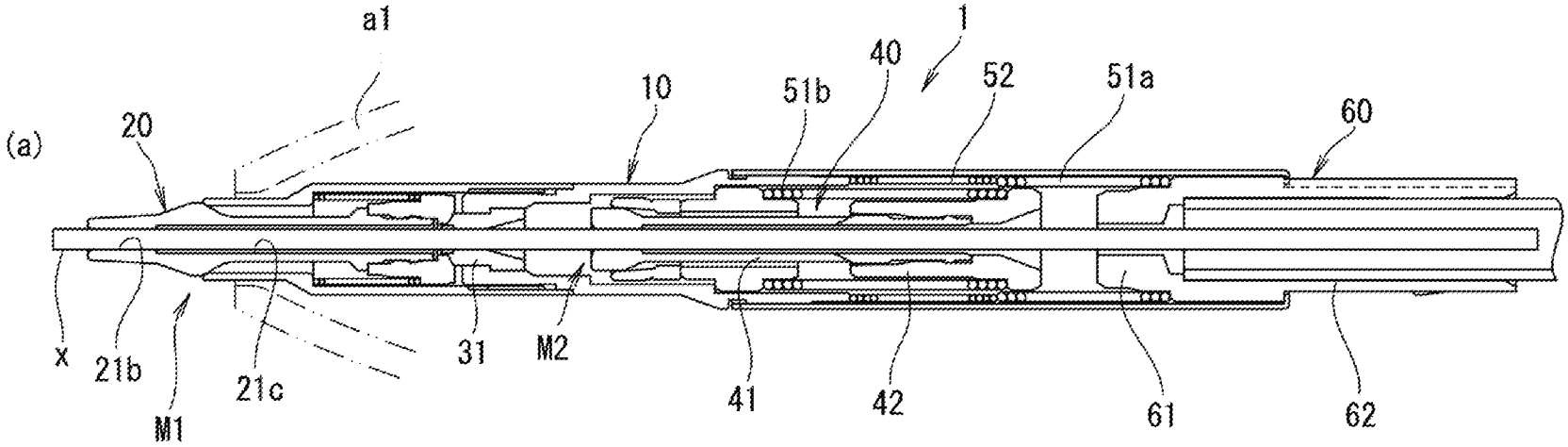
FIG. 8A is a full sectional view sequentially showing a situation where a holder goes forward by a force in a radial direction being applied to a pencil lead.

FIG. 8A shows a state (refer to FIG. 4) where the mechanical pencil unit 1 is locked while protruding from the shaft tube a1 in a similar manner to FIG. 7A.

Figure 8B:
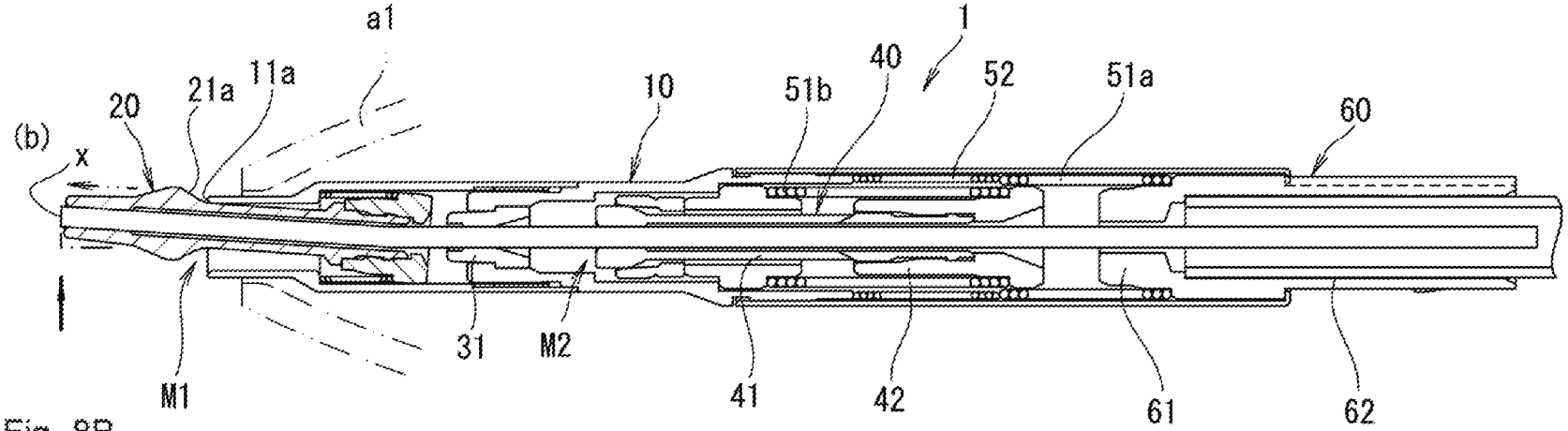
FIG. 8B is a full sectional view sequentially showing a situation where a holder goes forward by a force in a radial direction being applied to a pencil lead in continuation from FIG. 8A, in which only a part having moved from a previous state is indicated by hatching.

When an excessive force in the radial direction is applied to the pencil lead x by writing and the like in this protruding state, as shown in FIG. 8B, the cam slope 21*a* of the holder 20 slidingly contacts the front side opening portion 11*a* of the holding tube 10 and causes the holder 20 to go forward while being slightly tilted. Therefore, the holder 20 having gone forward covers a front end side of the pencil lead x being clipped by the chuck portion 40 and prevents breakage, damage, and the like of the pencil lead x.

In addition, when an excessive compressing force in a rearward direction and a radial direction is applied to the pencil lead x, both the operation shown in FIGS. 7A and 7B and the operation shown in FIGS. 8A and 8B are to be performed.

Figure 9A:
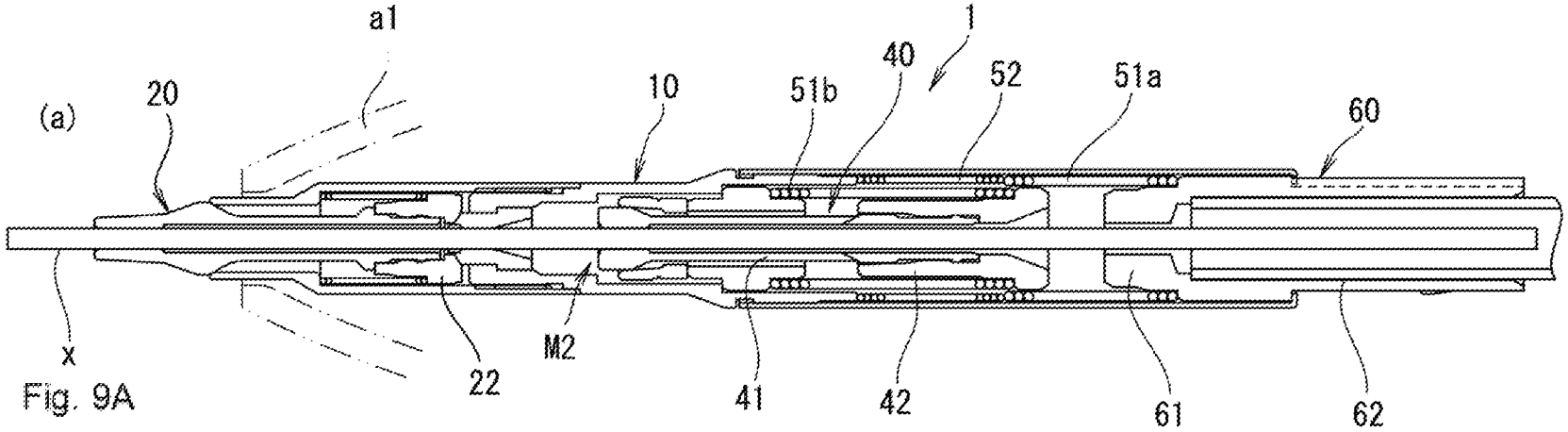
FIG. 9A is a full sectional view sequentially showing a situation where a holder goes forward and, at the same time, a pencil lead goes backward by a force applied in a rearward direction and a radial direction to the pencil lead.
Figure 9B:
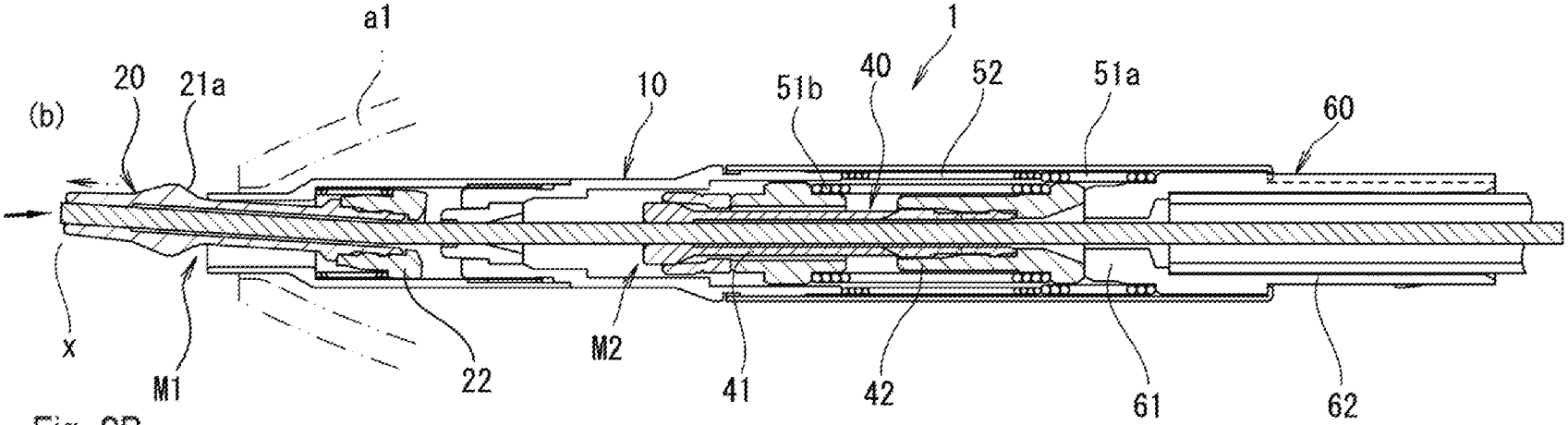
FIG. 9B is a full sectional view sequentially showing a situation where a holder goes forward and, at the same time, a pencil lead goes backward by a force applied in a rearward direction and a radial direction to the pencil lead in continuation from FIG. 9A, in which only a part having moved from a previous state is indicated by hatching.

In other words, as shown in FIGS. 9A and 9B, the pencil lead x and the chuck portion 40 move backward and, at the same time, the holder 20 goes forward to cover the front end side of the pencil lead x. Therefore, breakage, damage, and the like of the pencil lead x can be prevented.

Figure 10A:
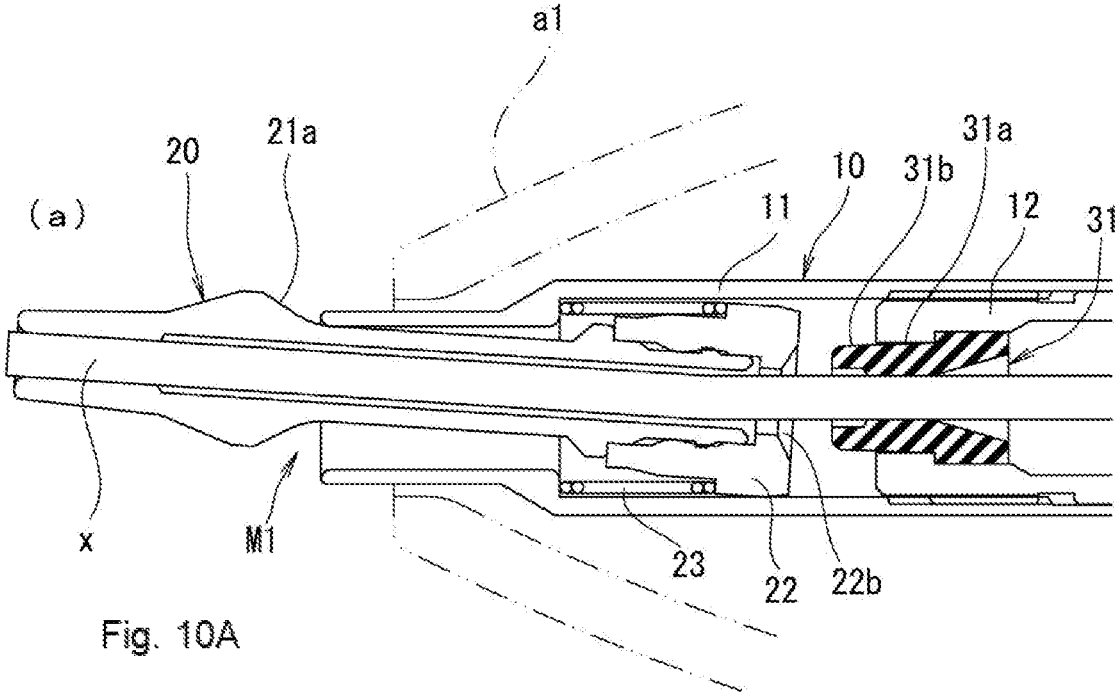
FIG. 10A is a full sectional view sequentially showing a situation where a holder touches a pencil lead breaker.
Figure 10B:
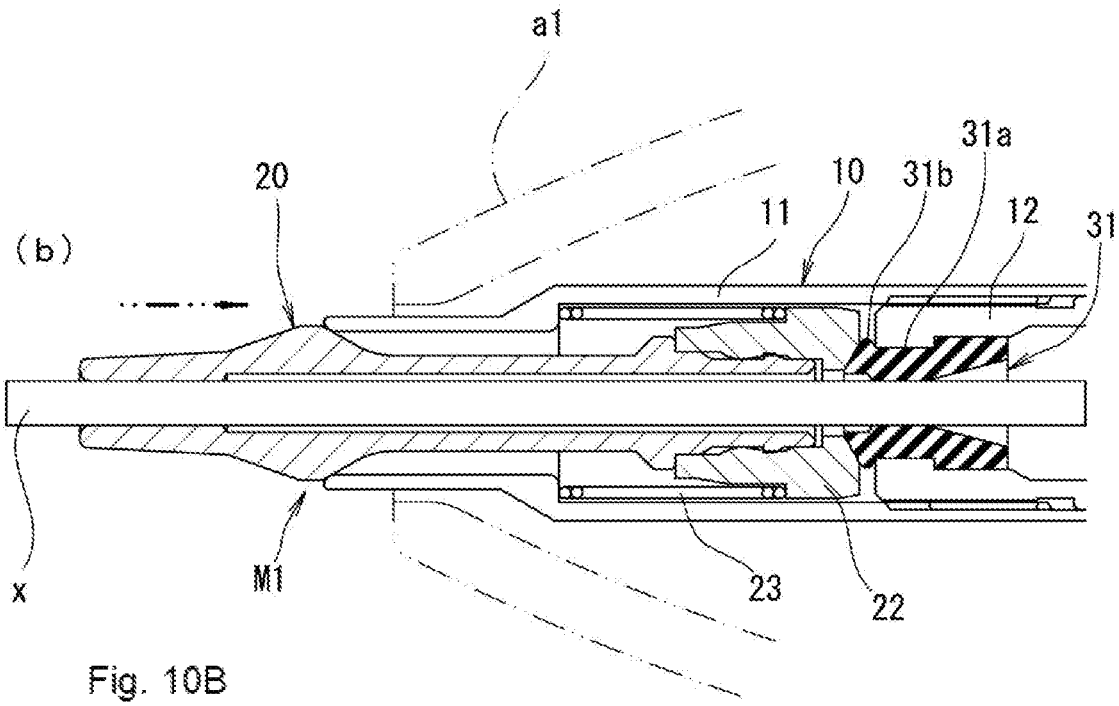
FIG. 10B is a full sectional view sequentially showing a situation where a holder touches a pencil lead breaker in continuation from FIG. 10A, in which only portions having moved from a previous state other than the pencil lead breaker are indicated by hatching.

Furthermore, when an excessive compressing force in the radial direction applied to the pencil lead x causes the holder 20 to go forward (refer to FIGS. 8A to 9B), when the excessive compressing force in the radial direction is subsequently removed, as shown in FIGS. 10A and 10B, the holder 20 is to move backward by an urging force of the holder urge member 23.

In doing so, since the receiver 22 on a rear end side of the holder 20 touches a protruding part 31*b* on a front end side of the pencil lead breaker 31 and the pencil lead breaker 31 elastically deforms, a sound created by touching can be reduced.

Figure 11A:
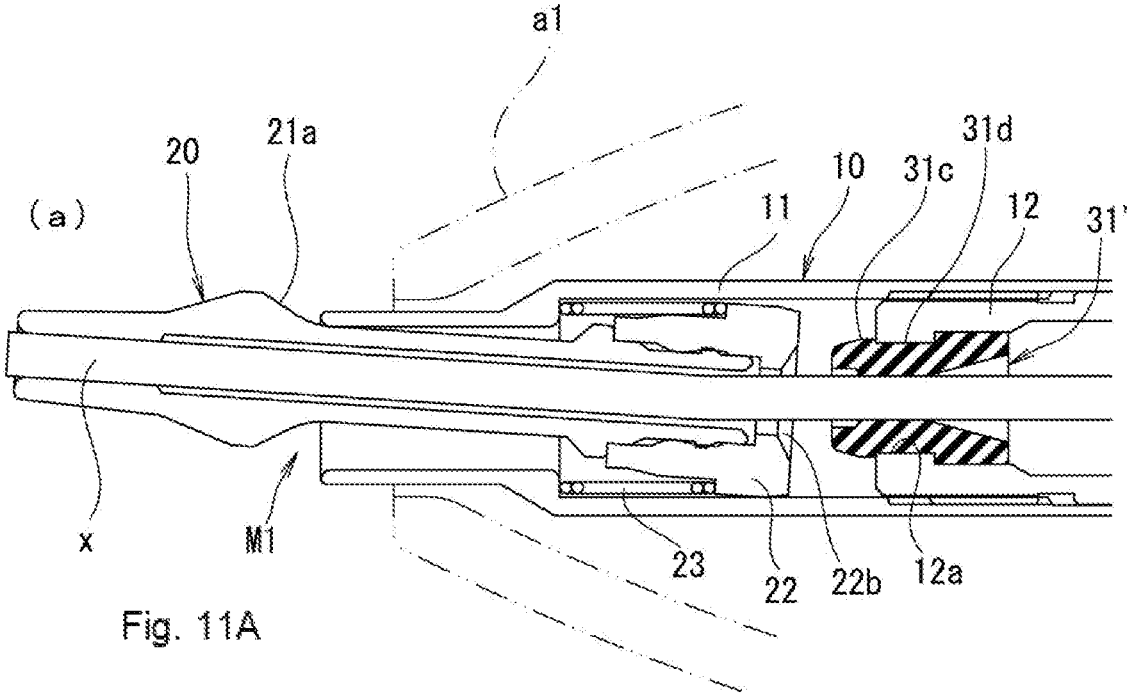
FIG. 11A is a full sectional view sequentially showing, in a mechanical pencil unit including another example of a pencil lead breaker, a situation where a holder touches the pencil lead breaker.
Figure 11B:
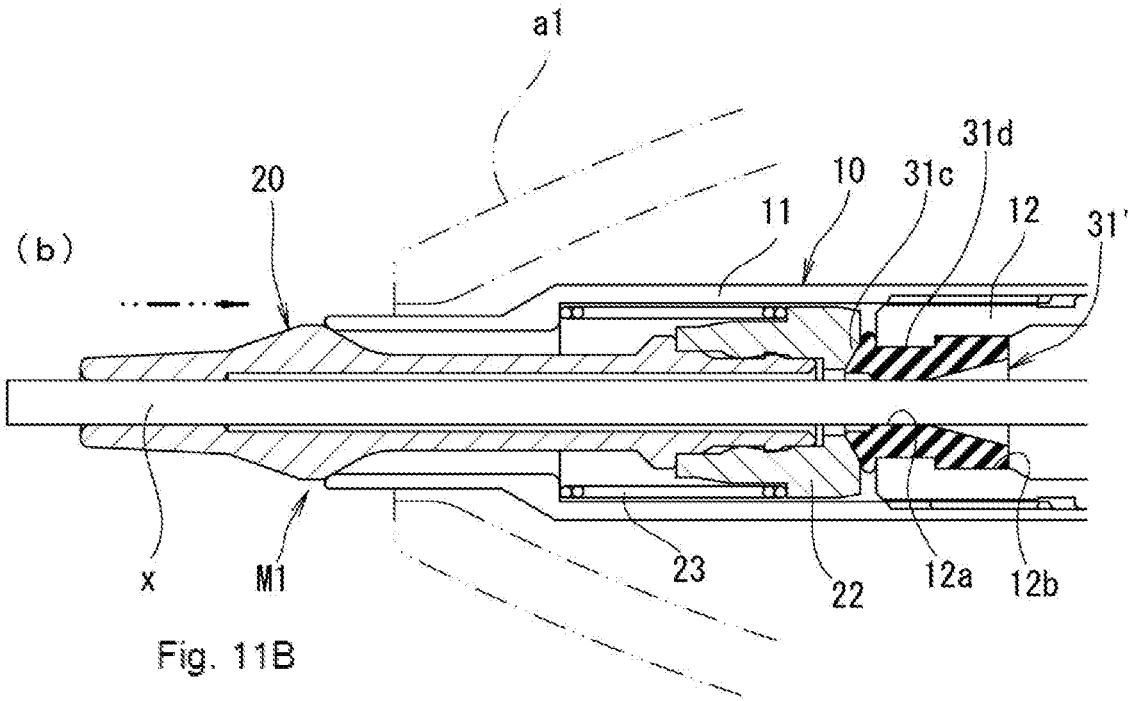
FIG. 11B is a full sectional view sequentially showing, in a mechanical pencil unit including another example of a pencil lead breaker, a situation where a holder touches the pencil lead breaker in continuation from FIG. 11A, in which only parts having moved from a previous state other than the pencil lead breaker are indicated by hatching.

Alternatively, as another example of the pencil lead breaker 31, a configuration of a pencil lead breaker 31' exemplified in FIGS. 11A and 11B may be adopted.

With the pencil lead breaker 31', by forming an increased diameter portion 31*c* in a part of the pencil lead breaker 31 which protrudes from the front end of the holding tube 10, an outer circumference portion on a rear side of the increased diameter portion 31*c* on the front end side of the pencil lead breaker 31 constitutes an annular recessed portion 31*d* and the annular recessed portion 31*d* is fitted with the annular projected portion 12*a* on the side of the holding tube 10.

According to the mechanical pencil unit 1 and the multi-function retractable writing utensil A using the pencil lead breaker 31', as shown in FIGS. 11A and 11B, the pencil lead breaker 31' is prevented by the increased diameter portion 31*c* from dropping off rearward from the holding tube 10 and, at the same time, a silencing effect can be improved by the increased diameter portion 31*c* with a relatively large outer diameter.

In addition, according to the embodiment described above, while the mechanical pencil unit 1 is applied with respect to a multi-function retractable writing utensil including a plurality of refills to a part of the plurality of refills, as other examples, a mode in which the mechanical pencil unit 1 is applied with respect to a retractable writing utensil configured with a single retractable refill to the single refill, a mode in which the mechanical pencil unit 1 is applied with respect a mechanical pencil configured with a non-retractable refill to the refill, and the like can be adopted.

Furthermore, according to the embodiment described above, while the holding tube 10 is integrally constituted by three independent tube portions (the first tube portion 11, the second tube portion 12, and the third tube portion 13), as another example, a part of or all of the tube portions may be constructed as a single integrated member. As yet another example, the holding tube 10 can be integrally constituted by four or more independent members.

In addition, according to the embodiment described above, while the first urge member 51*a* and the third urge member 51*b* are integrally configured as a two-stage spring as a favorable mode with particularly preferable productivity, as another example, the first urge member 51*a* and the third urge member 51*b* can also be respectively configured as separate coil springs.

In this case, the first urge member 51*a* engages with the receiver 42 integrated with the chuck portion 40 so as to urge the chuck portion 40 forward. This engagement structure can be applied to, for example, a mode which causes a front end portion of the first urge member 51*a* to engage with the receiver 42, a mode which provides a flange on the receiver 42 and which causes the front end portion of the first urge member 51*a* to touch a rear end face of the flange and, at the same time, causes a rear end portion of the second urge member 52 to touch a front end face of the flange, and the like.

Furthermore, according to the embodiment described above, while the holder 20 which is moved backward by the movement direction conversion mechanism M1 is configured to touch the pencil lead breaker 31, as another invention, in a mechanical pencil structure having a holder (including a pipe-like holder) which goes back and forth without including the movement direction conversion mechanism M1, a configuration can be adopted in which the holder is caused to touch the pencil lead breaker 31 to reduce a sound created by the touching.

In addition, according to the embodiment described above, while the entire pencil lead breaker 31 is formed of an elastic material as a particularly favorable mode, as another example, a mode can be adopted in which only a front end side part of the pencil lead breaker 31 is partially formed of an elastic material.

Furthermore, as a favorable configuration to be added to the embodiment described above, a guide member which protrudes rearward and which slidably fits with the connector 61 of the pencil lead tank portion 60 can be provided on a rear end side of the receiver 42 of the chuck portion 40 in order to further improve straight-advancing stability of the chuck portion 40.

Second Embodiment

Next, another embodiment of a mechanical pencil unit according to the present invention will be described. Since the embodiment described below represents a partial modification of the first embodiment described above, modified parts of the embodiment will be mainly described in detail and parts with similar functions will be denoted by same reference signs and overlapping detailed descriptions thereof will be omitted.

Figure 12A:
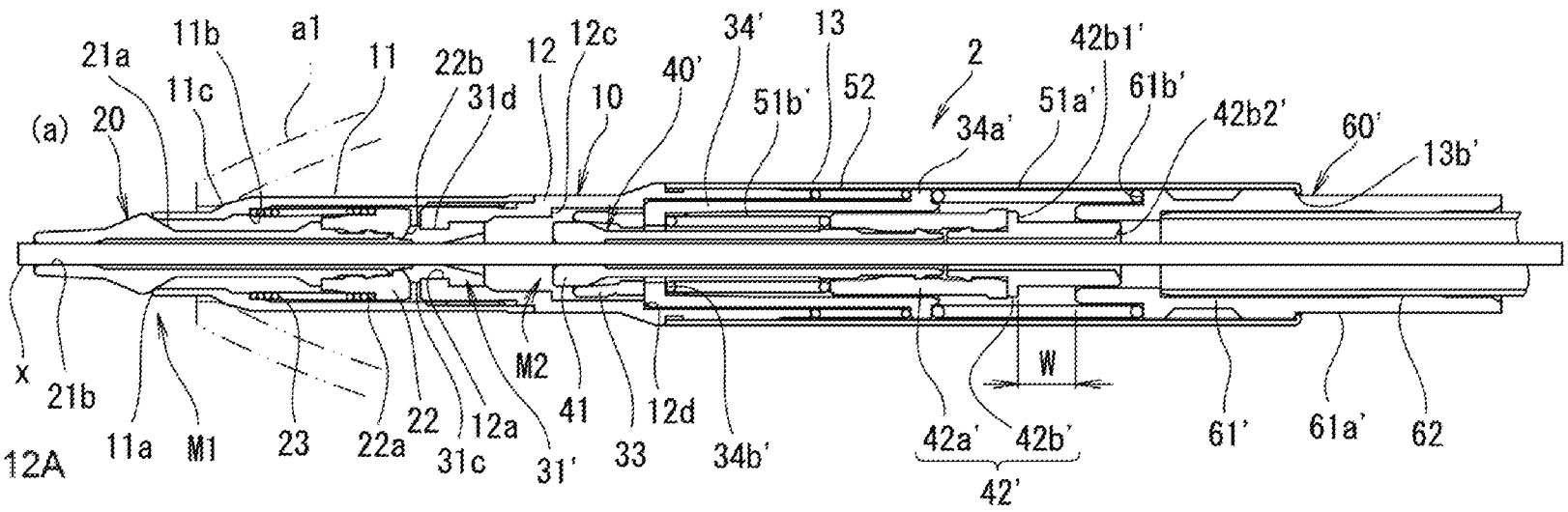
FIG. 12A is a full sectional view sequentially showing an operation for delivering a pencil lead with respect to a second embodiment of a mechanical pencil unit according to the present invention.
Figure 12B:
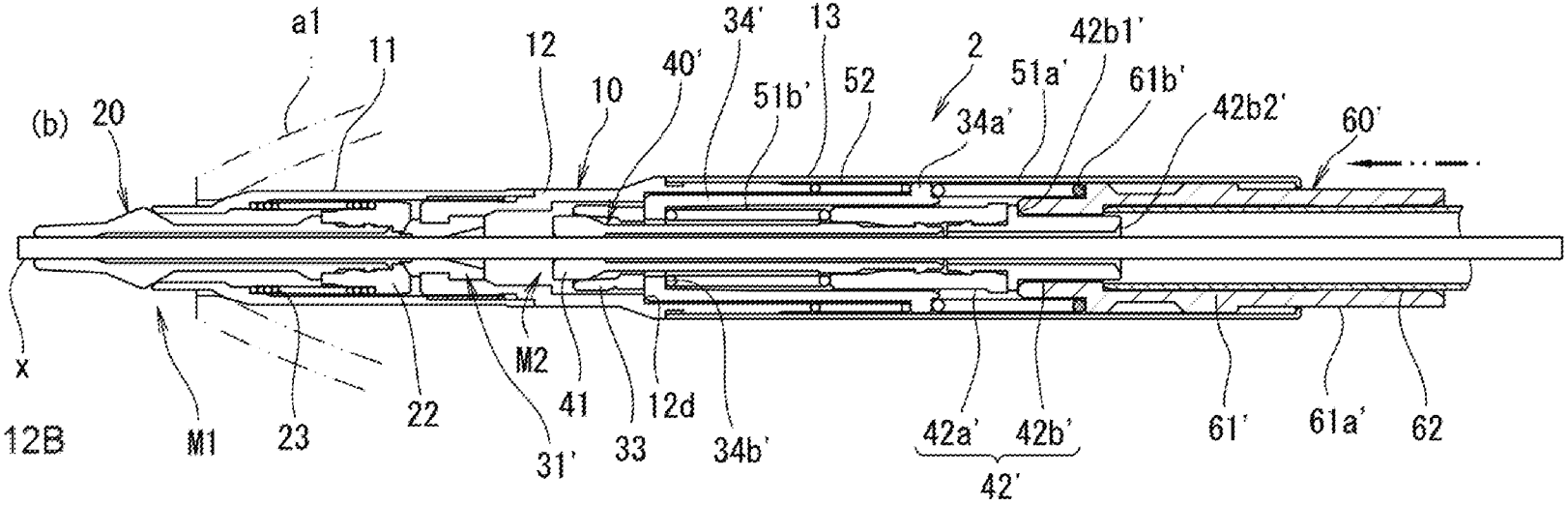
FIG. 12B is a full sectional view sequentially showing an operation for delivering a pencil lead with respect to a second embodiment of a mechanical pencil unit according to the present invention in continuation from FIG. 12A, in which only a part having moved from a previous state is indicated by hatching.

The main modifications of a mechanical pencil unit 2 shown in FIGS. 12A and 12B from the mechanical pencil unit 1 described above include the clutch receiver 34 being replaced with a clutch receiver 34', the chuck portion 40 being replaced with a chuck portion 40', the clutch urge member 51 (the first urge member 51*a* and the third urge member 51*b*) which is a two-stage spring being replaced with a first urge member 51*a'* and a third urge member 51*b'* which are respectively separate bodies, and the pencil lead tank portion 60 being replaced with a pencil lead tank portion 60'.

The clutch receiver 34' is a tubular member having the chuck main body 41 loosely inserted on a center side thereof.

A front end face of the clutch receiver 34' is locked by the stepped touched portion 12*d* in the holding tube 10.

In addition, a locking protrusion 34*a'* which protrudes outward in a radial direction is provided on an outer circumference face on a rear end side of the clutch receiver 34'.

A front end face of the locking protrusion 34*a'* receives a rear end seat portion of the second urge member 52. In addition, a rear end face of the locking protrusion 34*a'* receives a front end seat portion of the first urge member 51*a'*.

Furthermore, a diameter of a front end side of an inner circumferential portion of the locking protrusion 34*a'* is reduced, and a rear face of the reduced diameter portion constitutes a locking portion 34*b'* for locking the third urge member 51*b'*.

In addition, the clutch receiver 34' is positioned so as to provide a partition between the second urge member 52 on an outer side in a radial direction and the third urge member 51*b'* on an inner side in the radial direction.

The chuck portion 40' is constituted by the chuck main body 41 and a receiver 42' connected to a rear end side of the chuck main body 41.

The receiver 42' is constituted by a tubular sleeve 42*a'* annularly connected to the rear end side of the chuck main body 41 and a pencil lead tank guiding portion 42*b'* which is connected to a rear end side of the sleeve 42*a'* and which is inserted into the pencil lead tank portion 60'. Alternatively, the sleeve 42*a'* and the pencil lead tank guiding portion 42*b'* can be configured as a single member formed integrally in advance.

The sleeve 42*a'* is a cylindrical member, and a rear end side of the chuck main body 41 is inserted into and fitted with a front end side of an inner circumference face of the sleeve 42*a'*. In addition, a front end face of the sleeve 42*a'* receives a rear end portion of the third urge member 51*b'*.

The pencil lead tank guiding portion 42*b'* is a tubular member inserted and fixed to a rear end side of the sleeve 42*a'*, and includes a touching portion 42*b*1' which touches a front end portion of the pencil lead tank portion 60' when a space W between the front end of the pencil lead tank portion 60' and the touching portion 42*b*1' is reduced and a pencil lead introducing portion 42*b*2' which is provided so as to extend rearward from a portion on a radially inner direction side of the touching portion 42*b*1', which is inserted into the pencil lead tank portion 60', and which introduces the pencil lead x from a rearward side.

The touching portion 42*b*1' is formed in an annular shape so as to cause a rear end face of the touching portion 42*b*1' to touch a front end face of the pencil lead tank portion 60' in a state where a front end face of the touching portion 42b1' contacts a rear end face of the sleeve 42a'.

The pencil lead introducing portion 42b2' is formed in a tubular shape with a smaller outer diameter than the touching portion 42b1', and an outer circumference face on a rear portion side of the pencil lead introducing portion 42b2' slidingly contacts or is adjacent with an inner circumference face of the pencil lead tank portion 60'.

A rear end side of an inner circumference face of the pencil lead introducing portion 42b2' is chamfered in a mortar shape so as to enable the pencil lead x to be introduced.

The pencil lead tank portion 60' integrally includes a connector 61' and the tank main body 62 connected to a rear end side of the connector 61' and is configured in an approximately tubular shape having a front end portion opened.

The connector 61' is an approximately cylindrical member and is provided with, on a rear portion side of an outer circumference face thereof, an engaged portion 61a' of which a diameter has been reduced to enable engagement with an engaging portion 13b'. The engaging portion 13b' represents a modification of the engaging portion 13b (refer to FIGS. 2A and 2B) described above to an inward-facing annular protrusion.

In addition, a locking stepped portion 61b' with a cylindrical face shape for receiving the first urge member 51a' is provided on an outer circumference portion on a front end side of the connector 61'.

Alternatively, the engaging portion 13b' and the locking stepped portion 61' can be formed in a polygonal shape in a similar manner to the engaging portion 13b and the engaged portion 61a (FIGS. 2A to 3B) described earlier.

In addition, the first urge member 51a' and the second urge member 52 are respectively independent and separate coil springs.

An urging force of the first urge member 51a' is set so as to urge, relative to the pencil lead tank portion 60', the chuck portion 40' forward with an urging force set in advance which is stronger than writing pressure, and the urging force of the first urge member 51a' is larger than an urging force of the second urge member 52 but smaller than an urging force of the third urge member 51b'.

Moreover, the urging force of the second urge member 52 is larger than the urging force of the holder urge member 23.

A front end portion of the first urge member 51a' touches the locking protrusion 34a' on the rear end side of the clutch receiver 34', and a rear end portion of the first urge member 51a' touches the locking stepped portion 61b' on the front end side of the pencil lead tank portion 60'.

A front end portion of the third urge member 51b' touches the locking portion 34b' of the clutch receiver 34', and a rear end portion of the third urge member 51b' touches a front end of the receiver 42'.

The mechanical pencil unit 2 configured as described above is mounted to the multi-function retractable writing utensil A (refer to FIG. 4) in a similar manner to the mechanical pencil unit 1 described earlier, and produces operational effects approximately similar to those produced by the mechanical pencil unit 1.

For example, when the piece a2 is caused to go forward in the protruding state of the writing portion shown in FIG. 4, as shown in FIG. 12B, the pencil lead tank portion 60' (a hatched part) goes forward. During going forward, a position of the chuck portion 40' is held by a rearward urging force of the third urge member 51b' and only the first urge member 51a' with a smaller urging force than the third urge member 51b' contracts.

Therefore, a space W between the chuck portion 40' and the pencil lead tank portion 60' decreases and a front end of the pencil lead tank portion 60' touches the chuck portion 40' (more specifically, the touching portion 42b1') (refer to FIG. 12B).

Figure 13C:
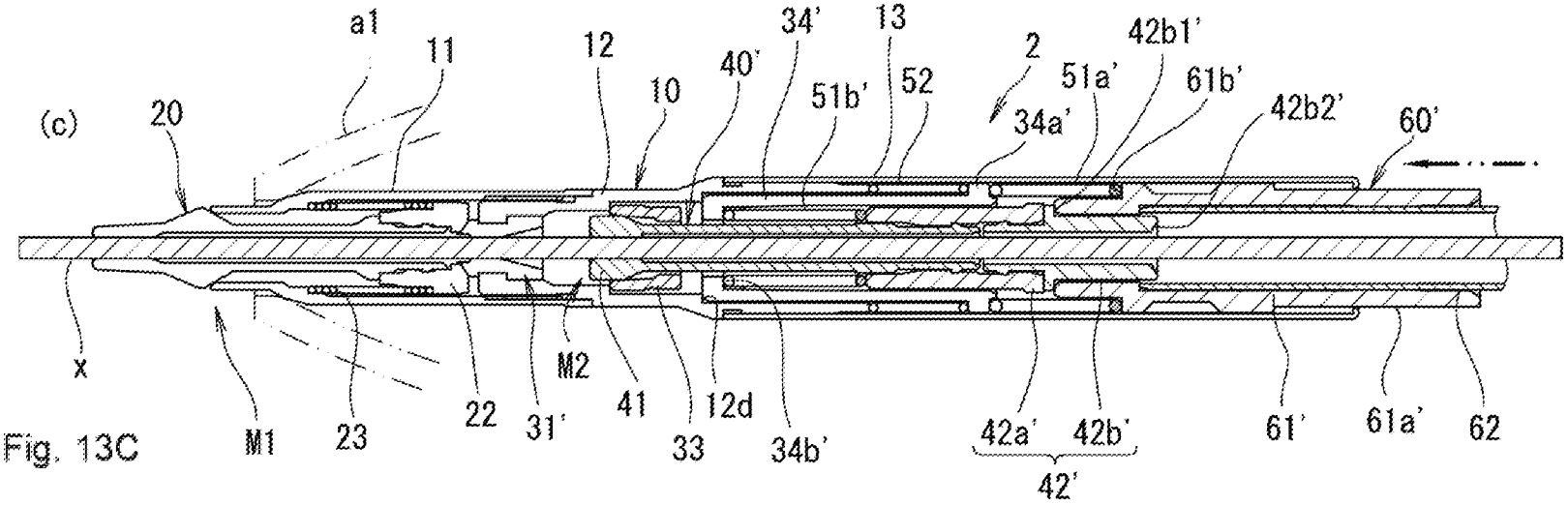
FIG. 13C is a full sectional view sequentially showing an operation for delivering a pencil lead in continuation from FIG. 12B, in which only a part having moved from a previous state is indicated by hatching.

Next, when the pencil lead tank portion 60' goes further forward, as shown in FIG. 13C, the first urge member 51a' and the third urge member 51b' contract, the chuck portion 40' clipping the pencil lead x goes forward, and the clutch ring 33 touches the locking portion 12c.

Figure 13D:
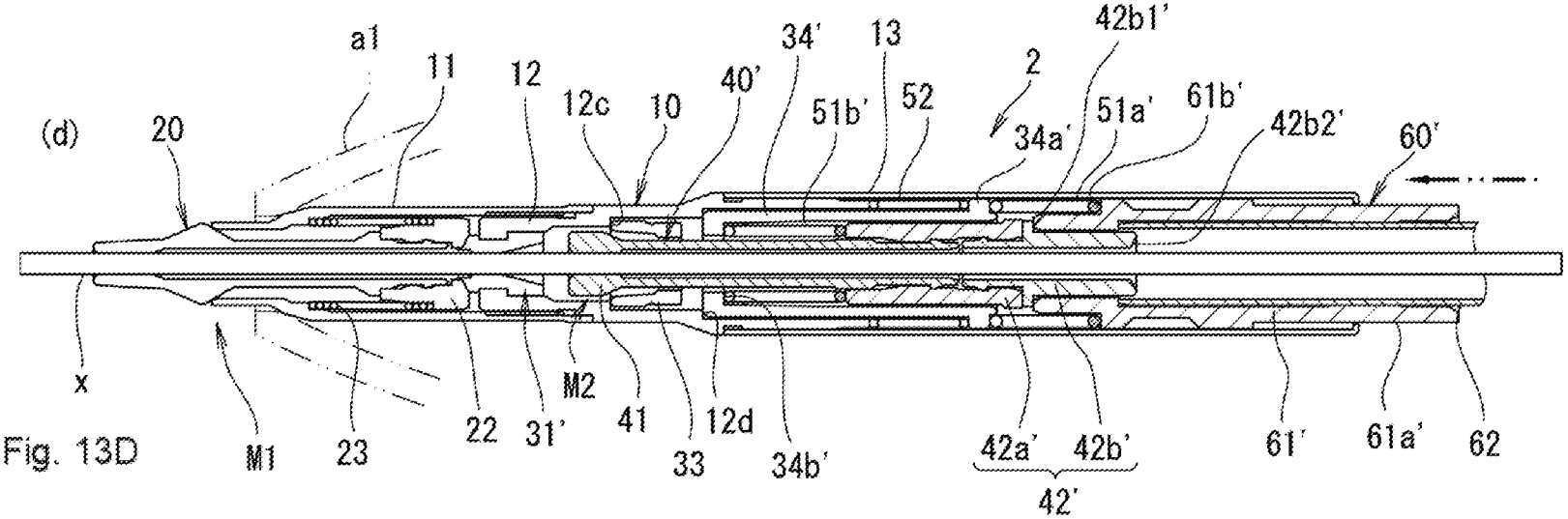
FIG. 13D is a full sectional view sequentially showing an operation for delivering a pencil lead in continuation from FIG. 13C, in which only a part having moved from a previous state is indicated by hatching.

Subsequently, when the chuck portion 40' goes further forward, as shown in FIG. 13D, the first urge member 51a' and the third urge member 51b' further contract, the clutch ring 33 touching the locking portion 12c disengages from the claw portions on the front end side of the chuck portion 40', and the chuck portion 40' elastically opens to release the pencil lead x. Since the released pencil lead x is loosely pressure contacted by the pencil lead breaker 31', the pencil lead x is held without moving back and forth.

Next, when a compressing force on the pencil lead tank portion 60 is removed, the pencil lead tank portion 60 moves backward by the urging force of the third urge member 51b', the first urge member 51a' extends, and the chuck portion 40' fits with the clutch ring 33 and clips the pencil lead x to restore the state shown in FIG. 12A.

Accordingly, the pencil lead can be delivered by a back and forth movement of the pencil lead tank portion 60'.

Figure 14A:
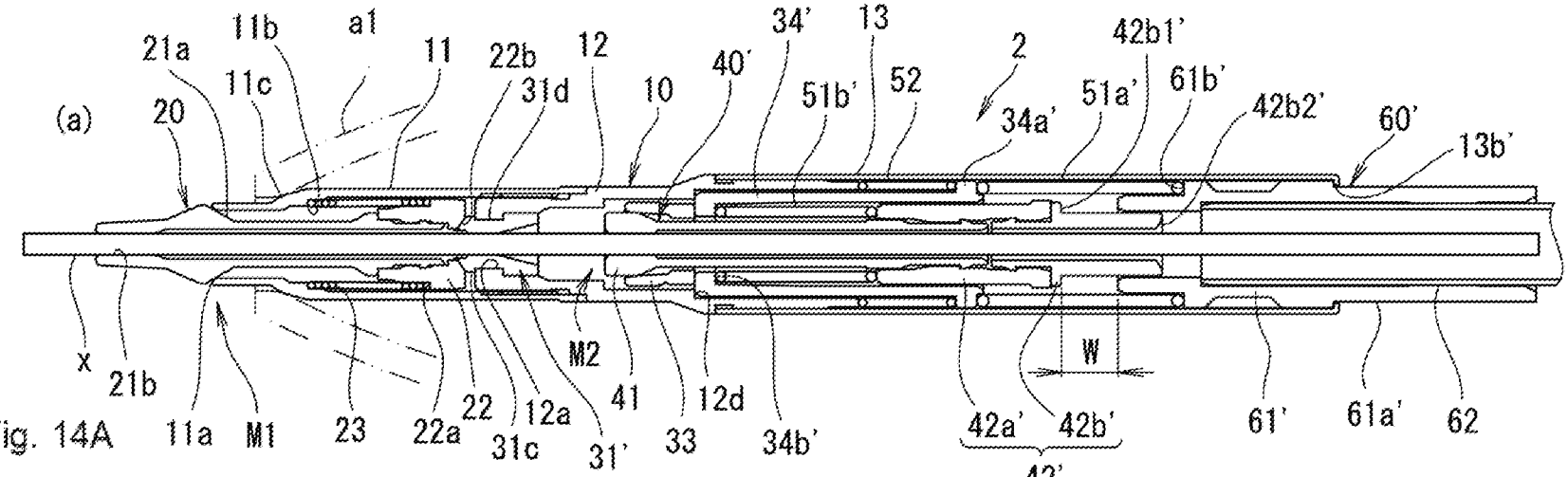
FIG. 14A is a full sectional view sequentially showing a situation where a pencil lead moves backward by a rearward compressing force according to the second embodiment.

Next, an operation when an excessive rearward compressing force is applied to the pencil lead x will be described in detail based on FIGS. 14A and 14B.

In a state where the mechanical pencil unit 2 protrudes from the shaft tube a1 (refer to FIG. 14A), the pencil lead tank portion 60' is held by the piece a2 of the multi-function retractable writing utensil A so as to be incapable of moving backward.

Figure 14B:
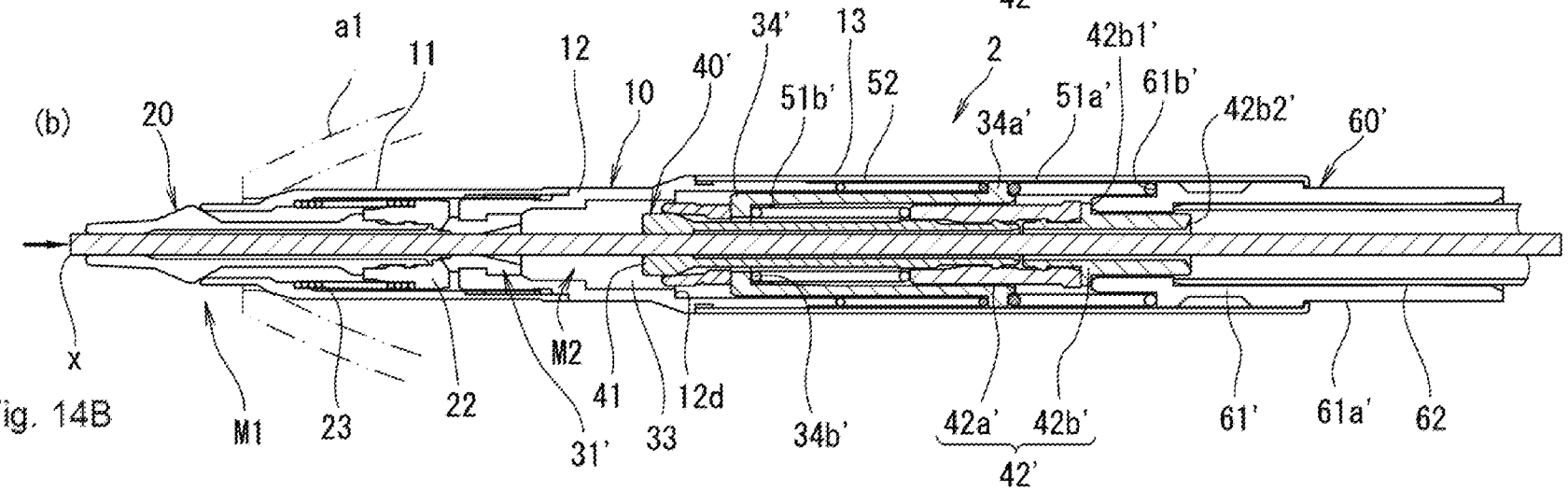
FIG. 14B is a full sectional view sequentially showing a situation where a pencil lead moves backward by a rearward compressing force according to the second embodiment in continuation from FIG. 14A, in which only a part having moved from a previous state is indicated by hatching.

When an excessive rearward force along an axial direction is applied to the pencil lead x by writing or the like in this protruding state, as shown in FIG. 14B, the pencil lead x and the chuck portion 40' clipping the pencil lead x cause the first urge member 51a' to contract and, at the same time, cause the second urge member 52 to extend by an elastic restoring force and then move backward. Therefore, breakage and damage of the pencil lead x can be prevented.

In addition, in the ballpoint pen refill 2, when an excessive compressing force in a radial direction is applied to the pencil lead x, the holder 20 covers and protects a front end side of the pencil lead x in a similar manner to the mechanical pencil unit 1 (refer to FIGS. 8A and 8B) described earlier.

Therefore, the mechanical pencil unit 2 is capable of performing a smooth delivery operation of the pencil lead x, providing protection for the pencil lead x, and the like in a similar manner to the mechanical pencil unit 1 described earlier. In addition, since an outer diameter can be reduced as compared to conventionally-structured mechanical pencil units, the mechanical pencil unit 2 is useful as a detachable mechanical pencil unit to be included in the multi-function retractable writing utensil A and the like.

Furthermore, with the mechanical pencil unit 2, the pencil lead introducing portion 42b2' on the rear end side of the chuck portion 40' prevents an occurrence of a situation where, for example, a broken pencil lead x or the like gets caught by the first urge member 51a'.

Moreover, the second urge member 52 and the third urge member 51b' can be prevented from interfering with each other by a side wall of the clutch receiver 34' positioned between the second urge member 52 and the third urge member 51*b'*.

Third Embodiment

Next, a third embodiment of a ballpoint pen refill according to the present invention will be described (refer to FIGS. 15 and 16).

The main modifications of the ballpoint pen refill 3 from the mechanical pencil unit 1 described earlier include the holding tube 10 being replaced with a holding tube 10' and the pencil lead breaker 31 being replaced with a pencil lead breaker 32.

The holding tube 10' is configured by replacing the second tube portion 12 in the holding tube 10 described earlier with a second tube portion 12'.

The second tube portion 12' is formed in an elongated, approximately cylindrical shape of a hard material such as metal and is detachably connected to the first tube portion 11 by a screw connection or the like. A frontmost tip portion of the second tube portion 12' is provided with an annular protrusion 12*b'* which is adjacent to or which contacts the outer circumference face of the pencil lead x being clipped by the chuck main body 41.

The annular protrusion 12*b'* is an annular protrusion which protrudes in a radially inner direction from a front end portion of the second tube portion 12' and which is continuous over an entire circumference.

An inner diameter of a smallest diameter part of the annular protrusion 12' is set to a slightly larger diameter than an outer diameter of the pencil lead x so that the pencil lead x can be loosely inserted into the annular protrusion 12' and that the annular protrusion 12' contacts the outer circumference face of the pencil lead x when the pencil lead x deflects.

In addition, a front end of a smallest part of the annular protrusion 12' is provided with a corner 12*b*1' (refer to FIG. 16) so as to encourage breaking of a touching pencil lead x.

In addition, the pencil lead breaker 32 is formed in an approximately cylindrical shape of an elastic material such as an elastomer resin or rubber. The pencil lead breaker 32 is fitted into and fixed in the second tube portion 12', and an inner circumference face of the pencil lead breaker 32 loosely pressure contacts the outer circumference face of the inserted pencil lead x.

Unlike the pencil lead breaker 31 described earlier, the pencil lead breaker 32 is not provided with a part which protrudes forward from the second tube portion 12'.

Therefore, according to the ballpoint pen refill 3 configured as described above, when an excessive compressing force is applied to a portion protruding forward from the second tube portion 12' in the pencil lead x as a result of attaching or detaching the first tube portion 11 (refer to FIG. 16) to or from the second tube portion 12' and the like, the protruding part can be caused to touch the annular protrusion 12*b'* to be severed on an outer side of the second tube portion 12' (refer to dashed-two dotted line in FIG. 16). Therefore, a broken pencil lead can be prevented from clogging inside the second tube portion 12'.

In addition, situations such as the pencil lead x breaking and tilting inside the second tube portion 12' and the tilted broken pencil lead obstructing a pencil lead from going forward subsequently can also be prevented.

While embodiments of the present invention have been described in detail above, it is to be understood that specific configurations of the present invention are not limited to these embodiments and that various design modifications and the like may be made without departing from the spirit and scope of the invention. In addition, the embodiments described above may be implemented so as to combine respective techniques thereof as long as no contradictions, problems, and the like arise in an object, a configuration, and the like of such implementations.

REFERENCE SIGNS LIST

1, 2, 3 Mechanical pencil unit
10, 10' Holding tube
11 First tube portion
12, 12' Second tube portion
12*b'* Annular protrusion
13 Third tube portion
20 Holder
21 Holder main body portion
22 Receiver
23 Holder urge member
31, 31', 32 Pencil lead breaker
31*d* Annular recessed portion
33 Clutch ring
34, 34' Clutch receiver
40, 40' Chuck portion
41 Chuck main body
42, 42' Receiver
42*b*1' Touching portion
42*b*2' Pencil lead introducing portion
51 Chuck portion urge member
51*a*, 51*a'* First urge member
51*b*, 51*b'* Third urge member
52 Second urge member
60, 60' Pencil lead tank portion
61, 61' Connector
62 Tank main body
A Multi-function retractable writing utensil
M1 Movement direction conversion mechanism
M2 Pencil lead delivering mechanism
W Space
x Pencil lead

The invention claimed is:

1. A mechanical pencil unit, comprising: a holding tube; a holder which is inserted into a front side opening portion of the holding tube and which protrudes forward from a front end of the holding tube, and which is supported so as to be back and forth movable relative to the holding tube; a pencil lead delivering mechanism which delivers forward a pencil lead inserted into the holder; and a movement direction conversion mechanism which causes the holder to go forward relative to the holding tube and the pencil lead by using a force applied in a radial direction from the pencil lead to the holder, wherein the pencil lead delivering mechanism is provided at a position further toward a rearward side of the mechanical pencil unit than the holder and the movement direction conversion mechanism.

2. The mechanical pencil unit according to claim 1, wherein on an inner circumference face of the holder, a pencil lead sliding contact surface which slidingly contacts an outer circumference face of a pencil lead on a front end side of the inner circumference face, and a pencil lead guide surface which is adjacent to the outer circumference face of the pencil lead at a position further toward a rear side than the pencil lead sliding contact surface are formed.

3. The mechanical pencil unit according to claim 1, wherein the holding tube includes a first tube portion immanent so as to cause the holder to protrude forward and a second tube portion connected to a rearward side of the first tube portion, and the holder and the movement direction conversion mechanism are provided inside the first tube portion and the pencil lead delivering mechanism is provided inside the second tube portion.

4. The mechanical pencil unit according to claim 1, wherein the pencil lead delivering mechanism includes a pencil lead breaker which is loosely pressure contacted by an outer circumference face of a pencil lead which is being delivered forward.

5. The mechanical pencil unit according to claim 4, wherein the pencil lead breaker receives from a rearward side thereof the holder by a front end side part made of an elastic material, and the pencil lead breaker is supported inside the holding tube.

6. The mechanical pencil unit according to claim 5, wherein an annular projected portion which protrudes in a radially inner direction is provided inside the holding tube, and the pencil lead breaker is formed in an approximately tubular shape having an annular recessed portion in an outer circumference portion thereof and causes the annular recessed portion to fit with the annular projected portion.

7. The mechanical pencil unit according to claim 4, wherein the pencil lead delivering mechanism includes a chuck portion which delivers forward a clipped pencil lead by a prescribed operation, the pencil lead delivering mechanism is immanent in the holding tube and the holding tube holds the chuck portion so as to be back and forth movable, the mechanical pencil unit further comprising:

a pencil lead tank portion which is connected to the holding tube so as to supply a pencil lead to the pencil lead delivering mechanism from a rearward side; and a first urge member which urges the chuck portion forward relative to the pencil lead tank portion with an urging force set in advance which is stronger than a writing pressure.

8. The mechanical pencil unit according to claim 7, wherein the holding tube is connected to the pencil lead tank portion so as to go back and forth by a prescribed amount, and a second urge member which urges the holding tube forward relative to a front end portion of the first urge member, and the urging force of which is smaller than that of the first urge member is provided.

9. The mechanical pencil unit according to claim 8, wherein the pencil lead delivering mechanism includes: the chuck portion which elastically deflects in a radially inner direction and which clips a pencil lead; a clutch ring which fits with the chuck portion in a clipping state and, when going forward together with the chuck portion, touches a touched portion of an inner face of the holding tube and disengages from the chuck portion; a clutch receiver which is provided so as to go back and forth by a prescribed amount inside the holding tube and which receives the clutch ring from a rearward side; the pencil lead breaker which is positioned on a further forward side than the clutch ring; and a third urge member which urges the chuck portion rearward relative to the clutch receiver, an urging force of the third urge member is set larger than an urging force of the first urge member, and the pencil lead tank portion and the chuck portion are provided so as to have a space in the back and forth direction and are provided so that one of the pencil lead tank portion and the chuck portion touches the other of the pencil lead tank portion and the chuck portion by narrowing the space.

10. The mechanical pencil unit according to claim 9, wherein a rear end side of the chuck portion is provided with a touching portion which touches a front end portion of the pencil lead tank portion when the space is narrowed and a pencil lead introducing portion which is provided so as to extend rearward from the touching portion and which is inserted into the pencil lead tank portion on a rear side of the space.

11. The mechanical pencil unit according to claim 9, wherein the clutch receiver is formed in a tubular shape, and the second urge member and the third urge member are respectively provided on an outer side and an inner side of a side wall of the clutch receiver in a radial direction thereof.

12. The mechanical pencil unit according to claim 9, wherein an urging force of the second urge member is set larger than a resistance force in a back and forth direction between the pencil lead breaker and a pencil lead.

13. The mechanical pencil unit according to claim 1, wherein the holding tube is provided with a hard annular protrusion which is adjacent to or which contacts an outer circumference face of a pencil lead delivered by the pencil lead delivering mechanism.

14. A writing utensil comprising the mechanical pencil unit according to claim 1.

* * * * *